US007968267B2

(12) United States Patent
Maeyama et al.

(10) Patent No.: US 7,968,267 B2
(45) Date of Patent: Jun. 28, 2011

(54) METHOD FOR DEVELOPING AN ELECTROSTATIC LATENT IMAGE

(75) Inventors: Takeshi Maeyama, Kawanishi (JP); Toshiya Natsuhara, Takarazuka (JP); Junya Hirayama, Takarazuka (JP); Masahiko Matsuura, Suita (JP); Shigeo Uetake, Takatsuki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 12/769,423

(22) Filed: Apr. 28, 2010

(65) Prior Publication Data

US 2010/0232841 A1 Sep. 16, 2010

Related U.S. Application Data

(62) Division of application No. 11/712,107, filed on Feb. 28, 2007, now abandoned.

(30) Foreign Application Priority Data

Mar. 6, 2006 (JP) ..... 2006-059196
Jan. 10, 2007 (JP) ..... 2007-002256
Feb. 16, 2007 (JP) ..... 2007-036120

(51) Int. Cl.
*G03G 13/08* (2006.01)

(52) U.S. Cl. ..... 430/123.58; 430/120.1; 399/253; 399/270; 399/272; 399/273

(58) Field of Classification Search ..... 430/120.1, 430/123.51, 123.58; 399/253, 270, 272, 399/273

See application file for complete search history.

(56) References Cited

U.S. PATENT DOCUMENTS 4,639,115 A 1/1987 Lin
5,231,458 A 7/1993 Nishimura et al.
5,391,455 A * 2/1995 Bigelow ..... 430/122.1
5,506,372 A 4/1996 Guth et al.
5,715,501 A 2/1998 Aita et al.
5,802,430 A * 9/1998 Wada ..... 399/253
5,991,587 A 11/1999 Kikuchi
6,463,245 B1 10/2002 Suwa et al.

(Continued)

FOREIGN PATENT DOCUMENTS

EP 654 714 A 1/1994

(Continued)

OTHER PUBLICATIONS

Translation of JP 2003-215855 published Jul. 2003.*

(Continued)

*Primary Examiner* — Christopher RoDee
*Assistant Examiner* — Peter L Vajda
(74) *Attorney, Agent, or Firm* — Brinks Hofer Gilson & Lione

(57) ABSTRACT

The purpose is to provide, in a development apparatus using a two-component developer, a compact development apparatus, image forming apparatus and development method that prevents carrier deterioration and that can carry out good image formation over a long time period. In a development apparatus using a developer in which are mixed a toner, a carrier, and opposite polarity particles that are charged to a polarity opposite to the charging polarity of the toner, the surface charge density of the opposite polarity particles should be in the range of 0.5 to 3.0 times the surface charge density of the carrier.

23 Claims, 4 Drawing Sheets

U.S. PATENT DOCUMENTS

| | | | |
|---|---|---|---|
| 6,512,909 | B2 | 1/2003 | Ozawa et al. |
| 6,721,516 | B2 | 4/2004 | Aoki et al. |
| 2004/0228661 | A1 | 11/2004 | Fujishima et al. |
| 2007/0092306 | A1 | 4/2007 | Matsuura et al. |

FOREIGN PATENT DOCUMENTS

| | | | | |
|---|---|---|---|---|
| EP | 0 772 097 | A2 | | 5/1997 |
| EP | 1 324 149 | A2 | | 7/2003 |
| JP | 59-100471 | | | 6/1984 |
| JP | 06 295123 | A | | 10/1994 |
| JP | 09-185247 | | | 7/1997 |
| JP | 2000-298396 | | | 10/2000 |
| JP | 2002-108104 | | | 4/2002 |
| JP | 2003-057882 | | | 2/2003 |
| JP | 2003-215855 | | * | 7/2003 |
| JP | 2005-189708 | | | 4/2005 |

OTHER PUBLICATIONS

Partial European Search Report, Application No. EP 06019262 dated Dec. 8, 2006.

Partial European Search Report, Application No. EP 06019262.2 dated May 9, 2007, 2 pages.

Non-final Office Action dated Apr. 3, 2009 issued in related U.S. Appl. No. 11/519,597.

Final Office Action dated Nov. 10, 2009 issued in related U.S. Appl. No. 11/519,597.

Non-final Office Action dated Feb. 19, 2010, issued in related U.S. Appl. No. 11/982,904.

Restriction Requirement dated Aug. 19, 2009, issued in related U.S. Appl. No. 11/712,107.

Non-final Office Action dated Jan. 29, 2010, issued in related U.S. Appl. No. 11/712,107.

Non-final Office Action dated Aug. 7, 2009, issued in related U.S. Appl. No. 11/805,815.

Non-final Office Action dated Apr. 15, 2009 issued in related U.S. Appl. No. 11/584,891.

Final Office Action dated Nov. 10, 2009 issued in related U.S. Appl. No. 11/584,891.

* cited by examiner

METHOD FOR DEVELOPING AN ELECTROSTATIC LATENT IMAGE

CROSS-REFERENCE TO RELATED APPLICATIONS

This is a divisional application of, and claims the benefit of priority from application Ser. No. 11/712,107, filed Feb. 28, 2007, entitled Development Apparatus, Image Forming Apparatus and Development Method, and currently pending.

This application is based on Japanese Patent Application No. 2006-059196 filed on Mar. 6, 2006, No. 2007-002256 filed on Jan. 10, 2007, and No. 2007-036120 filed on Feb. 16, 2007, in Japanese Patent Office, the entire content of which is hereby incorporated by reference.

TECHNICAL FIELD

The present invention relates to development apparatus, image forming apparatus and development method of developing the electrostatic latent image on an image carrier using a developer having a toner and a carrier.

BACKGROUND

Conventionally, as the methods of developing the electrostatic latent image formed on the image carrier in an image forming apparatus using the electro-photographic method, the one-component developing system which uses only a toner as the developing agent and the two-component developing system which uses a toner and a carrier are known.

Generally, in the one-component developing system, the toner is charged by passing the toner through a regulating section that has a toner supporting member and a regulating plate that presses against that toner supporting member, a desired toner layer is formed and the electrostatic latent image is developed. Therefore, since the development is made in a state of close proximity between the toner supporting member and the image carrier, it is superior in dot reproducibility, and also, by forming a uniform toner layer, it is possible to obtain a uniform image without the generation of image irregularity that is caused by a magnetic brush in the two component development method. In addition, it is considered to be advantageous in terms of simplification of the apparatus, size reduction, and achieving low cost. However, on the other hand, because of the strong stress in the regulating section, the surface properties of the toner get altered thereby reducing the charge-receiving property of the toner, and the surfaces of the toner regulating member and the toner supporting member get contaminated due to the adhesion of the toner or of the external additive agents, and hence the property of applying charge to the toner gets reduced thereby causing the problem of fogging due to insufficient charging of the toner and the problem of contamination inside the apparatus. Therefore, there is the problem of the life of the development apparatus becoming short.

On the other hand, in the two-component development system, since the toner is charged by friction charging due to mixing the toner with a carrier, the stress is small, and this method is very advantageous regarding toner deterioration. In addition, even because surface area is large of the carrier which is the material applying electric charge to the toner, this method is relatively strong against contamination caused by toner or external additive agents, and this method is advantageous for making the life longer.

However, even when a two-component developer is used, the surface of the carrier does get contaminated by the toner and the external additive agents, the amount of charging of the toner gets reduced over a long time of use, and problems such as fogging or toner splashing occur, and the life can not be said to be sufficient, and a still longer life is desired.

In the Japanese Laid-Open Patent Application Publication No. S59-100471 is disclosed a development apparatus that suppresses the increase in the ratio of deteriorated carriers by replenishing in small quantities the carrier in the developer together with the toner or independently, and accordingly, the replacement of carrier is carried out by discharging the deteriorated developer whose charging property has gone down. Since the carriers are being replaced in this apparatus, it is possible to suppress to a constant level the reduction in the extent of charging of the toner due to carrier deterioration, and this method is advantageous in terms of obtaining a long life of the apparatus.

Further, in the Japanese Laid-Open Patent Application Publication No. 2003-215855 is disclosed a two-component developer having a toner in which are externally added particles having the property of being charged to a polarity opposite to the charging polarities of the carrier and the toner and a development method using this developer. In this method, it has been indicated that particles with opposite polarity charging property are added with the intention of acting as polishing material and spacer particles, and that there is the effect of suppressing deterioration due to the effect of removing the spent matters on the surface of the carrier. In addition, it is said that there is the effect of improving the cleaning in the image carrier cleaning section and of polishing the image carrier.

Further, in the Japanese Laid-Open Patent Application Publication No. H9-185247 is disclosed a so-called hybrid type development method in which only the toner in the two-component developer is made to be carried on to the toner-supporting member opposite the image carrier and the electrostatic latent image on the image carrier is developed. In the hybrid development method, image unevenness due to a magnetic brush is not generated, and hence the method has excellent dot reproducibility and image uniformity. In addition, this method has other features that are not present in normal two-component development methods such as there is no occurrence of transfer of the carriers to the image carrier (carrier consumption) because there is no direct contact between the image carrier and the magnetic brush, etc. In the hybrid development method, since the charging of the toner is done due to friction with the carrier, maintaining the charge applying property of the carrier is important in stabilizing the chargeability of the toner and maintaining good image quality over a long period.

However, in the development apparatus disclosed in the Japanese Laid-Open Patent Application Publication No. S59-100471, there are problems in the aspects of cost and environment because a mechanism for recovering the discharged carrier is necessary, and because the carrier becomes a consumable item. In addition, it is necessary to repeat the printing for a prescribed volume until the ratio of old to new carriers becomes stable, and it is not necessarily possible to maintain the initial characteristics. Further, in the Japanese Laid-Open Patent Application Publication No. 2003-215855, the amounts of consumption of the toner and the opposite polarity charging particles differ depending on the image area ratio, particularly when the image area ratio is small, the consumption of the opposite polarity charging particles adhered to the large non-image area becomes excessive, and there is the problem that the effect of suppressing the carrier deterioration in the development apparatus becomes lower. In addition, in the hybrid development method disclosed in the Japanese Laid-Open Patent Application Publication No. H9-185247, there is the problem that as the number of sheets printed increases, the surface of the carrier gets contaminated by toner and post-processing materials, and the charge applying property of the carrier decreases successively.

SUMMARY

A purpose of the present invention is to provide, in a development apparatus using a two-component developer, a compact development apparatus, and a development method that suppress carrier deterioration and can carry out image formation in a stable manner over a long time. In view of forgoing, one embodiment according to one aspect of the present invention is a development apparatus, comprising:

a developer tank which is adapted to store developer including toner, carrier for charging the toner and opposite polarity particles which are charged in an opposite polarity to a polarity of electrostatic charge of the toner;

a developer supporting member which supports the developer to convey the developer in the developer tank toward a development area; and a separation mechanism which is adapted to separate the opposite polarity particles or the toner from the developer on the developer supporting member at an upstream side of the development area in a developer moving direction, wherein a surface charge density of the opposite polarity particles is in the range from 0.5 to 3.0 times of a surface charge density of the carrier.

According to another aspect of the present invention, another embodiment is an image forming apparatus, comprising:

an electrostatic latent image carrier;

an image forming mechanism which is adapted to form an electrostatic latent image on the electrostatic latent image carrier;

a development apparatus mentioned above for developing the electrostatic latent image on the electrostatic latent image carrier so as to transform the electrostatic latent image into a toner image; and an image transfer mechanism which is adapted to transfer the toner image formed on the electrostatic latent image carrier onto a media.

According to another aspect of the present invention, another embodiment is a developing method for developing an electrostatic latent image with toner, the developing method comprising the steps of:

conveying developer stored in a developer tank by use of a developer supporting member, wherein the developer includes the toner, carrier for charging the toner and opposite polarity particles which are charged in an opposite polarity to a polarity of an electrostatic charge of the toner, and a surface charge density of the opposite polarity particles is in the range from 0.5 to 3.0 times of a surface charge density of the carrier;

separating the opposite polarity particles from the developer on the developer supporting member at a position of an upstream side of the development area in a developer moving direction, thereby the developer from which the opposite polarity particles has been separated is conveyed to the development area; and collecting the separated opposite polarity particles into the developer tank.

According to another aspect of the present invention, another embodiment is developing method for developing an electrostatic latent image with toner at a development area, the developing method comprising the steps of:

conveying developer stored in a developer tank by use of a developer supporting member, wherein the developer includes the toner, carrier for charging the toner and opposite polarity particles which are charged in an opposite polarity to a polarity of an electrostatic charge of the toner, and a surface charge density of the opposite polarity particles is in the range from 0.5 to 3.0 times of a surface charge density of the carrier;

DETAILED DESCRIPTION OF THE PREFERRED EMBODIMENT

Figure 1:
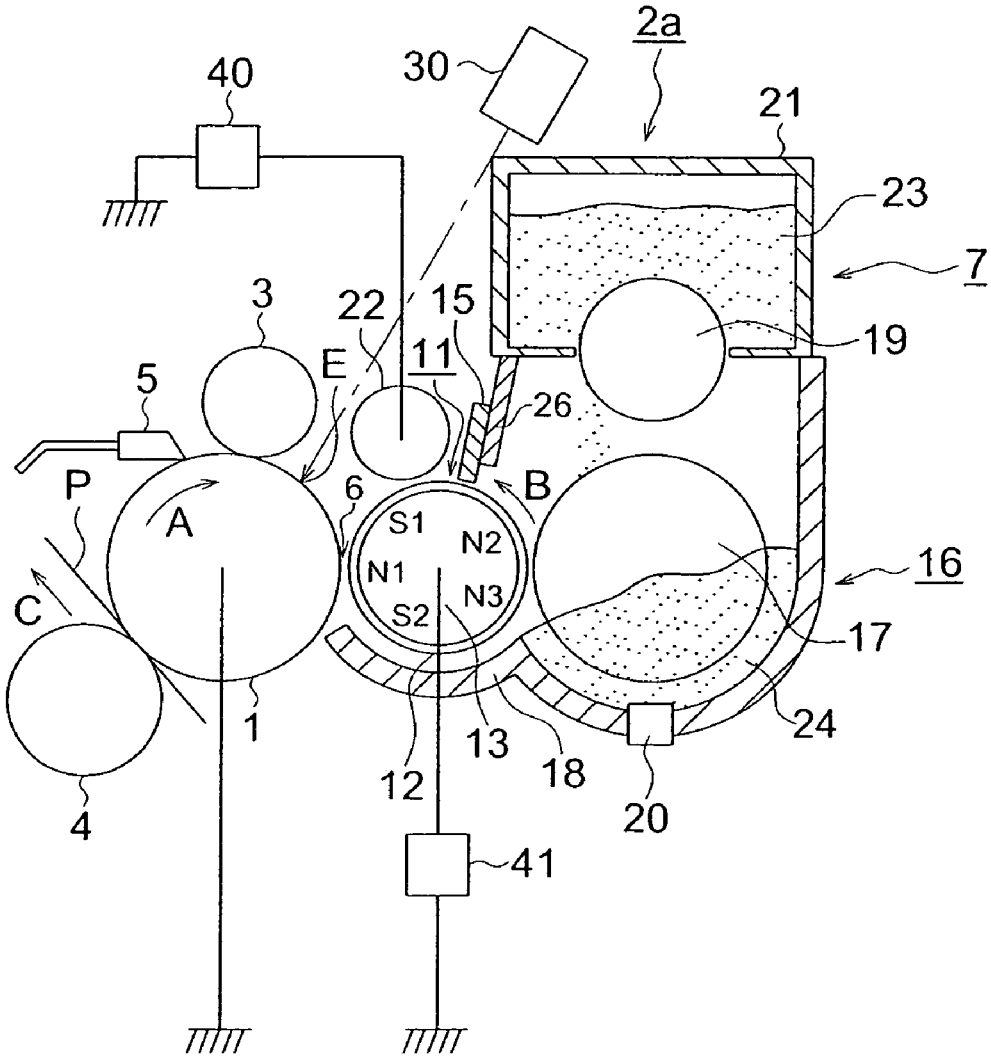
FIG. 1 is an outline configuration diagram showing the important part of an image forming apparatus according to a preferred embodiment of the present invention.

A preferred embodiment of the present invention is explained in detail as an example in the following while referring to the drawings. While the preferred embodiments of the present invention have been described using specific terms, such description is for illustrative purpose only, and it is to be understood that changes and variations may be made without departing from the spirit or scope of the appended claims.

FIG. 1 is an outline configuration diagram showing the important part of an image forming apparatus according to a preferred embodiment of the present invention. This image forming apparatus is a printer that carries out image forming by transferring on to a transfer medium P such as paper sheets, etc., the toner image formed on an electric latent image carrier such as an image carrier 1 (photoreceptor) using the electrophotographic method. This image forming apparatus has an image carrier 1 for bearing the image, and in the surroundings of the image carrier 1 are placed a charging unit 3 for charging the image carrier 1, a developing apparatus 2*a* for developing the electrostatic latent image on the image carrier 1, an image transfer mechanism such as a transfer roller 4 for transferring the toner image on the image carrier 1, and a cleaning blade 5 for removing the residual toner on the image carrier 1, which are all arranged in that sequence along the rotation direction A of the image carrier 1.

The image carrier 1 is formed by coating a photoreceptor layer on the surface of a grounded base body, and after this photoreceptor layer is charged using the charging unit 3, it is exposed at the position of the point E in the figure by an image forming mechanism such as an exposure unit 30 provided with a laser light emitting unit, etc., thereby forming an electrostatic latent image on its surface. The development unit 2*a* develops the electrostatic latent image on the image carrier 1 into a toner image. The transfer roller 4, after transferring the toner image on the image carrier 1 on to the transfer medium P, discharges it in the direction of the arrow C in the figure. The cleaning blade 5 removes by mechanical force the residual toner remaining on the image carrier 1 after the transfer. Well-known electro-photography technology can be used for the image carrier 1, the charging unit 3, the exposure unit 30, the transfer roller 4, and the cleaning blade 5, etc., that are used for image forming apparatus. For example, although a charging roller has been shown in the figure as a charging unit, it is also possible to use a charging unit that does not come into contact with the image carrier 1. For example, there may not be a cleaning blade.

The development apparatus 2*a* in the present preferred embodiment has the feature that it is provided with a developer tank 16 that stores the developer 24, a developer supporting member 11 that carries on its surface and conveys the developer fed from said developer tank 16, and a separation mechanism that separates the toner or the opposite polarity particles from the developer on said developer supporting member 11, and the opposite polarity particles are recovered into the developer tank 16. Because of this it is possible to suppress the consumption of the opposite polarity particles, and also, these opposite polarity particles can effectively complement the charge bearing property of the carriers, and as a result, it is possible to suppress the carrier deterioration over a long period of time. Because of this, even when images with relatively small image area ratios are formed successively, it is possible to maintain effectively the toner charging amount over a long period of time.

If the development apparatus does not have said separation mechanism, particularly when the image area ratio is small, the effect of suppressing carrier deterioration inside the development apparatus decreases. This phenomenon is considered to occur based on the following mechanism. In a two-component development apparatus, by forming a strong electric field in the development area by applying an oscillating electric field, etc., the property is being improved of separating the toner from the carrier in the developer. When a developer having opposite polarity particles is used, the three items of carriers, toner, and opposite polarity particles are separated, and while the carriers remain on the developer supporting member due to the magnetic suction force, the toner is consumed in the image part and the opposite polarity particles are consumed in the non-image area of the electrostatic latent image. Therefore, depending on the image area ratio, the balance between the rates of consumption of the toner and the opposite polarity particles does not become stable, particularly when images with large background area are printed in large quantities, the opposite polarity particles in the developer are consumed with priority, it will not be possible to correct the carrier charging property, and the effect of suppressing carrier deterioration gets reduced.

In the present preferred embodiment, the developer 24 is one having a toner, carriers and opposite polarity particles for charging that toner. The charging polarity inside the developer of the opposite polarity particles is such that they can be charged to a polarity opposite to the polarity of the charge on the toner, and these are particles the average value of the surface charge density of which is in the range of 0.5 to 3.0 times the average value of the surface charge density of the carriers in the developer. For example, when the toner is charged negatively by the carrier, the opposite polarity particles in the developer are charged positively, and these are positively charging particles the average value of the surface charge density of which is in the range of 0.5 to 3.0 times the average value of the surface charge density of the carriers that are similarly charged positively. Again, for example, when the toner is charged positively by the carrier, the opposite polarity particles in the developer are charged negatively, and these are negatively charging particles the average value of the surface charge density of which is in the range of 0.5 to 3.0 times the average value of the surface charge density of the carrier's that are similarly charged negatively. By including opposite polarity particles in a two-component developer and also by accumulating opposite polarity particles within the developer over time due to the separation mechanism, it is possible, even if the charge bearing property of the carrier gets reduced due to spent matter of toner or post processing agent on the carrier, to compensate for the charge bearing property of the carrier effectively because even the opposite polarity particles can charge the toner with the proper polarity, and as a result, it is possible to suppress the deterioration of the carrier.

When the average value of the surface charge density of the opposite polarity particles in the developer is less than 0.5 times the average value of the surface charge density of the carriers in the developer, since the charge applying property of the surface of the opposite polarity particles is too small compared to the charge applying property of the surface of the carriers, even if opposite polarity particles get adhered on the surface of the particles, it is not possible to provide sufficient charge applying property to the carrier. As a result, a problem is occurring that the amount of charge of the toner decreases with the number of pages printed, causing deterioration in the background fogging and increase in the toner splashing within the apparatus. In addition, when the average value of the surface charge density of the opposite polarity particles in the developer is more than 3.0 times the average value of the surface charge density of the carriers in the developer, since the charge applying property of the surface of the opposite polarity particles is too large compared to the charge applying property of the surface of the carriers, when the opposite polarity particles get adhered on the surface of the carriers, an excessive charge applying property is given to the carrier. As a result, a problem occurs that the amount of charge on the toner increases with the number of pages printed, inviting reduction in the density and deterioration of the dot reproducibility.

The appropriately used opposite polarity particles are selected suitably depending on the charging property of the toner. When a negatively charging toner is used, fine particles that are charged positively are used as the opposite polarity particles. For example, it is possible to use inorganic particles such as strontium titanate, barium titanate, alumina, etc., or to use particles made of thermoplastic resins or thermosetting resins such as acrylic resin, benzoguanamine resin, nylon resin, polyimide resin, polyamide resin, etc., also, it is possible to include in the resin some positive charging control agents that apply positive charge, or it is possible to configure nitrogen containing copolymers. Further, it is also possible to make them positively charging fine particles by carrying out surface treatment that applies positive charging property on the surface of fine particles having negative charging property.

On the other hand, when a positively charging toner is used, fine particles that are charged negatively are used as the appropriate opposite polarity particles, and for example, inorganic particles such as silica, titanium dioxide, etc., are added and fine particles constituted from thermosetting resins or thermoplastic resins such as resins containing fluorine, polyolefin resins, silicone resins, polyester resins, etc., are used, or else, it is also possible to include in the resins a negatively charging control agent that gives negative charging property to the resin, or to constitute using copolymers of acrylic type monomers containing fluorine, or methacrylate type monomers containing fluorine. Further, it is also possible to make them negatively charging fine particles by carrying out surface treatment that applies positive charging property on the surface of fine particles having positive charging property.

Further, in order to control the charging property and the hydrophobicity of opposite polarity particles, it is also possible to carry out surface treatment of the surface of the inorganic fine particles using a silane coupling agent, a titanium coupling agent, silicone oil, etc., and in particular, when giving positive charging property to the inorganic fine particles, it is desirable to carry out surface treatment with a coupling agent having an amino radical, or when giving negative charging property, it desirable to carry out surface treatment using a coupling agent having a fluorine radical.

It is desirable that the number average particle diameter of the opposite polarity particles is in the range of 100 to 1000 nm.

The toner used is not particularly restricted, and it is possible to use any publicly known toner that is used ordinarily, and it is also possible to use a toner that is produced by including a coloring agent, and if necessary, charging control agent, releasing agent, etc., in a binder resin and carrying out the processing of external additives. Although the toner particle diameter is not restricted, it is desirable that it is in the range from 3 to 15 μm.

For the manufacture of this type of toner, it is possible to use a generally used well-known method, for example, it is possible to manufacture using the methods of grinding method, emulsion polymerization method, suspension polymerization method, etc.

For the binder resin used for the toner, although not restricted to these, it is possible to use, for example, styrene type resins (homopolymers or copolymers having styrene or styrene substitutes) or polyester resins, epoxy type resins, vinyl chloride resins, phenol resins, polyethylene resins, polypropylene resins, polyurethane resins, silicone resins, etc. Depending on the individual resin or their combinations of these resins, it is desirable to select those with a softening temperature in the range of 80 to 160° C. and a glass transition temperature in the range of 50 to 75° C.

Further, for the coloring agent, it is possible to use any of the generally used and widely known materials, for example, carbon black, aniline black, activated charcoal, magnetite, benzene yellow, permanent yellow, naphthol yellow, pthalocyanine blue, fast sky blue, ultramarine blue, rose bengal, lake red, etc. can be used, and in general it is desirable to use 2 to 20 parts by mass of these for 100 parts by mass of the above binder resin.

Further, even for the above charging control agent it is possible to use any well known agents, and as the charging control agent for positively charging toners, it is possible to use, for example, nigrosine series dyes, quaternary ammonium salt type compounds, tri-phenyl methane type compounds, imidazole type compounds, polyamine resin, etc. As the charging control agent for negatively charging toners, it is possible to use azo type dyes containing metals such as Cr, Co, Al, Fe, etc., metal salicylate type compounds, metal acrylic salicylate type compounds, calixarene compounds, etc. Generally, it is desirable to use 0.1 to 10 parts by mass of the charging control agent for 100 parts by mass of the above binder resin.

Further, even for the above releasing agent it is possible to use any well-known agents which are generally used, and it is possible to use, for example, polyethylene, polypropylene, carnauba wax, sasol wax, etc., either independently or as combinations of two or more types, and in general, it is desirable to use 0.1 to 10 parts by mass of the releasing agent for 100 parts by mass of the above binder resin.

Further, even for the above external additives it is possible to use any of the well-known additives which are generally used, and it is possible to use, for example, fine inorganic particles such as silica, titanium oxide, aluminum oxide, etc., fine particles of resins such as acrylic resin, styrene resin, silicone resin, resins containing fluorine, etc., for fluidity improvement, and in particular, it is desirable to use external additives that have been hydrophobized using silane coupling agent, titanium coupling agent, or silicone oil, etc. Further, such fluidizing agents are used by mixing 0.1 to 5 parts by mass for every 100 parts by mass of the above toner. Although the diameters of the particles of the external additives are not particularly restricted, it is desirable that the primary number average particle diameter of external additives is in the range of 10 to 100 nm.

Although the carrier used is not particularly restricted, it is possible to use any generally used and well-known carrier, and it is possible to use binder type carriers, or coated type carriers. Although the diameters of the particles of the carrier are not particularly restricted, it is desirable that the primary number average particle diameter of the carriers is in the range of 15 to 100 μm.

A binder type carrier is one in which magnetic fine particles are dispersed in a binder resin, and it is possible to provide fine particles, that can be charged positively or negatively, adhered on the surface of the carriers or to provide a surface coating layer on them. The charging characteristics such as the charging polarity, etc., of binder type carriers can be controlled by the types of the material of the binder resin, the chargeable fine particles, and of the surface coating layer.

Some examples of the binder resin used in binder type carriers are thermoplastic resins such as vinyl type resins typified by polystyrene type resins, polyester type resins, nylon type resins, polyolefin type resins, etc., and thermosetting type resins such as phenol resins.

For the magnetic fine particles of binder type carriers, it is possible to use spinel ferrites such as magnetite, gamma ferric oxide, etc., spinel ferrites that have one or more types of non-ferrous metals (Mn, Ni, Mg, Cu, etc.), magneto plumbite type ferrites such as barium ferrite, etc., or particles of iron or alloy with oxide layers on their surfaces. Their shapes can be any of particular, spherical, or needle shapes. In particular, when high magnetization is necessary, it is desirable to use iron based ferromagnetic fine particles. Further, if chemical stability is considered, it is desirable to use ferromagnetic fine particles of spinel ferrites having magnetite or gamma ferric oxide, or magneto plumbite type ferrites such as barium ferrite, etc. By selecting appropriately the type and content of ferromagnetic particles, it is possible to obtain a magnetic resin carrier having the desired magnetization. It is appropriate to add 50 to 90 percent by mass of magnetic fine particles in the magnetic resin carrier.

As the surface coating material of binder type carriers are used silicone resin, acrylic resin, epoxy resin, resins containing fluorine, etc., and it is possible to increase the charge applying capacity by forming a coated layer by coating these resins on the surface and hardening them.

The attaching of chargeable fine particles or conductive fine particles on the surface of a binder type carrier is done, for example, by first uniformly mixing magnetic resin carriers and fine particles and adhering these fine particles on the surface of magnetic resin carriers, and then applying mechanical and thermal shock force thereby making the fine particles to be shot inside and fixed in the magnetic resin carriers. In this case, the fine particles are not completely buried inside the magnetic resin carriers but are fixed so that a part of them are projecting out from the surface of the magnetic resin carriers. Organic or inorganic dielectric materials are used for the chargeable fine particles. In concrete terms, it is possible to use organic dielectric particles of polystyrene, styrene type copolymers, acrylic resin, various types of acrylic copolymers, nylon, polyethylene, polypropylene, resins containing fluorine, and cross-linked materials of these, etc., and it is possible to obtain the desired level of charging and polarity based on the material, polymerizing catalyst, surface treatment, etc. In addition, it is possible to use inorganic particles with negative charging property such as silica, titanium dioxide, etc., and to use inorganic particles with positive charging property such as strontium titanate, alumina, etc.

On the other hand, coated type carriers are carriers in which carrier core particles made of a magnetic material are coated with resin, and even in the case of coated type carriers it is possible, similar to the case of binder type carriers, to attach fine particles that can be charged to positive or negative polarity. It is possible to control the polarity and charging characteristics of coated type carriers based on the type of the surface coating layer and of the chargeable fine particles, and it is possible to use materials similar to those in the case of the binder type carriers. Particularly, the same type of resins as the binder resin of binder type of carriers can be used as the coating resin.

Figure 3:
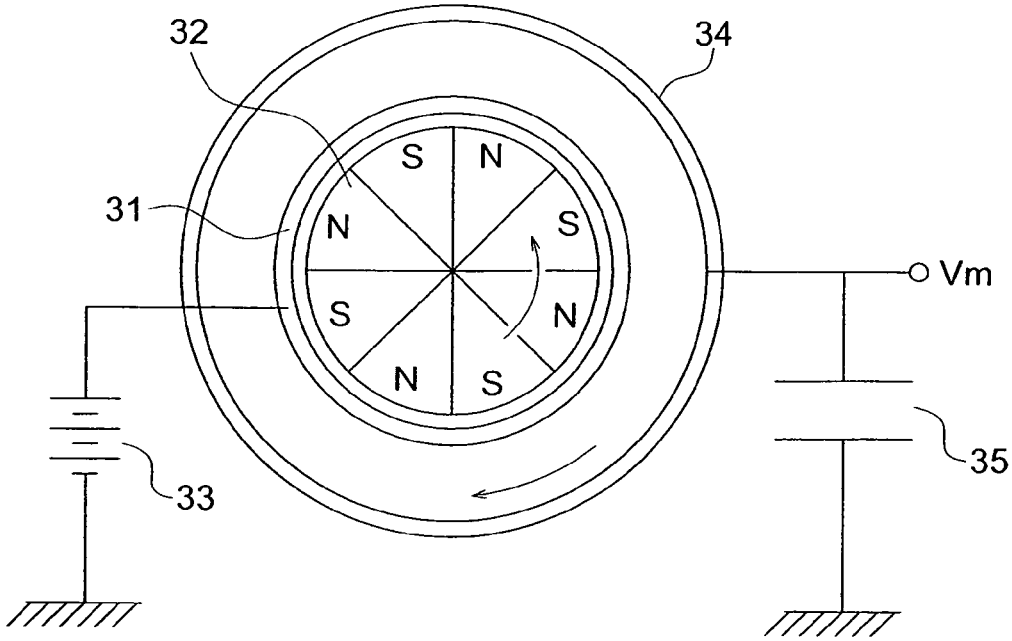
FIG. 3 is an outline configuration diagram showing a charge amount measurement apparatus.

The charging property of the opposite polarity particles and toner due to the combination of the opposite polarity particles, the toner, and the carrier can be found easily from the direction of the electric field for separating the toner or the opposite polarity particles from the developer using the apparatus of FIG. 3 after they have been mixed and stirred to prepare the developer. To begin with, the developer is placed uniformly over the entire surface of the conductive sleeve 31 using the magnetic force of the magnet roller 32, and after that, the metal electrode 34 is placed so that it is not in contact with the developer. Next, when the magnet roller 32 is rotated while applying a voltage to the metal sleeve from a power supply 33, due to the electric field, the particles with the same polarity as the applied voltage fly to the metal electrode 34. It is possible to know the charging polarity of the toner or the opposite polarity particles by carrying out this operation after changing the polarity of the voltage.

It is sufficient to adjust the ratio of mixing the toner and the carrier so that the desired toner charging amount is obtained, and a ratio of toner quantity to the total quantity of toner and carrier of 3 to 50% by mass is appropriate, and more preferably, 5 to 20% by mass depending on the ratio of the surface area due to the difference of the particle diameter between the toner and the carrier.

Although the quantity of opposite polarity particles contained in the initial developer is not particularly restricted as long as the purpose of the present invention is achieved, for example, it is 0.01 to 5.00 parts by mass relative to 100 parts by mass of the carrier, and particularly 0.01 to 2.00 parts by mass is more desirable.

The developer can be prepared, for example, after carrying out the treatment of external addition of opposite polarity particles to the toner, by mixing the toner with the carrier.

In the development apparatus 2*a*, an opposite polarity particle recovery member 22 that separates and recovers the opposite polarity particles from the developer on the developer supporting member 11 is used as the separation mechanism that separates the toner or the opposite polarity particles from the developer on the developer supporting member 11. The opposite polarity particle recovery member 22, as is shown in FIG. 1, is provided on the upstream side in the direction of developer movement from the development area 6 in the developer supporting member 11, and by applying an opposite polarity particle separating bias, the opposite polarity particles in the developer are electrically separated and collected on the surface of the opposite polarity particle recovery member 22. After the opposite polarity particles are separated by the opposite polarity particle recovery member 22, the remaining developer on the developer supporting member 11, that is, the toner and the carrier, are continued to be conveyed, and the electrostatic latent image on the image carrier 1 is developed in the development area 6.

The opposite polarity particle recovery member 22, as an electric field forming member, is connected to the power supply 40, a prescribed opposite polarity particle separation bias is applied, and the developer supporting member 11 is connected to the power supply 41. Because of this, the opposite polarity particles in the developer are electrically separated and collected on the surface of the opposite polarity particle recovery member 22.

The opposite polarity particle separation bias applied to the opposite polarity particle recovery member 22 differs depending on the charging polarity of the opposite polarity particles, that is, when the toner is charged negatively and the opposite polarity particles are charged positively, it is a voltage that has a lower average value than the average value of the voltage applied to the developer supporting member 11, and when the toner is charged positively and the opposite polarity particles are charged negatively, it is a voltage that has a higher average value than the average value of the voltage applied to the developer supporting member 11. In both the cases of the opposite polarity particles being charged positively and negatively, it is desirable that the difference between the average voltage applied to the opposite polarity particle recovery member 22 and the average voltage applied to the developer supporting member 11 is 20 to 500V, and particularly desirably 50 to 300V. When the potential difference is too small, it becomes difficult to recover sufficiently the opposite polarity particles. On the other hand, when the potential difference is too large, the carrier being held by magnetic force on the developer supporting member 11 gets separated due to the electric field, and there is the likelihood of the ideal development function being lost in the development area.

In the development apparatus 2*a*, in addition, it is desirable that an alternating electric field is formed between the opposite polarity particle recovery member 22 and the developer supporting member 11. Since the toner makes reciprocating movement due to the formation of an alternating electric field, it is possible to separate effectively the opposite polarity particle adhered on the surface of the toner, and it is possible to improve the recoverability of the opposite polarity particles. At this time, it is desirable that an electric field $2.5\times10^6$ V or more is formed. By forming an electric field of $2.5\times10^6$ V/m or more, it becomes possible to separate the opposite polarity particles from the toner also by electric field, and it is possible to improve still further the separation and recovery of opposite polarity particles.

In the present patent specifications, the electric field formed between the opposite polarity particle recovery member 22 and the developer supporting member 11 is called the opposite polarity particle separation electric field. Normally, such an opposite polarity particle separation electric field is obtained by applying an alternating voltage to either on of both of the opposite polarity particle recovery member 22 and the developer supporting member 11. In particular, when an alternating voltage is applied to the developer supporting member 11 for developing the electrostatic image with toner, it is desirable to form the opposite polarity particle separation electric field using the alternating voltage applied to the developer supporting member 11. At this time, it is sufficient if the maximum value of the absolute value of the opposite polarity particle separation electric field is within the above range.

For example, if the charging polarity of opposite polarity particles is positive and a DC voltage superimposed with an AC voltage is applied to the developer supporting member 11, and only a DC voltage is applied to the opposite polarity particle recovery member 22, only a DC voltage lower than the average value of the voltage (AC+DC) applied to the developer supporting member 11 is applied to the opposite polarity particle recovery member 22. Furthermore, for example, if the charging polarity of opposite polarity particles is negative and a DC voltage superimposed with an AC voltage is applied to the developer supporting member 11, and only a DC voltage is applied to the opposite polarity particle recovery member 22, only a DC voltage higher than the average value of the voltage (AC+DC) applied to the developer supporting member 11 is applied to the opposite polarity particle recovery member 22. At these times, the maximum value of the absolute value of the opposite polarity particle separation electric field is the maximum value of the potential difference between the voltage (AC+DC) applied to the developer supporting member 11 and the DC voltage applied to the opposite polarity particle recovery member 22 divided by the gap at the closest point between the opposite polarity particle recovery member 22 and the developer supporting member 11, and it is desirable that this value is within the above range.

Furthermore, if the charging polarity of opposite polarity particles is positive and only a DC voltage is applied to the developer supporting member 11, and a DC voltage superimposed with an AC voltage is applied to the opposite polarity particle recovery member 22, a DC voltage superimposed with an AC voltage with an average value lower than the value of the DC voltage applied to the developer supporting member 11 is applied to the opposite polarity particle recovery member 22. Furthermore, for example, if the charging polarity of opposite polarity particles is negative and only a DC voltage is applied to the developer supporting member 11, and a DC voltage superimposed with an AC voltage is applied to the opposite polarity particle recovery member 22, only a DC voltage superimposed with an AC voltage with an average value higher than the value of the DC voltage applied to the developer supporting member 11 is applied to the opposite polarity particle recovery member 22. At these times, the maximum value of the absolute value of the opposite polarity particle separation electric field is the maximum value of the potential difference between the DC voltage applied to the developer supporting member 11 and the voltage (DC+AC) applied to the opposite polarity particle recovery member 22 divided by the gap at the closest point between the opposite polarity particle recovery member 22 and the developer supporting member 11, and it is desirable that this value is within the above range.

Furthermore, if the charging polarity of opposite polarity particles is positive and a DC voltage superimposed with an AC voltage is applied to both the developer supporting member 11 and the opposite polarity particle recovery member 22, then, DC voltage superimposed with an AC voltage with an average value lower than the average value of the DC voltage superimposed with an AC voltage applied to the developer supporting member 11 is applied to the opposite polarity particle recovery member 22. Furthermore, for example, if the charging polarity of opposite polarity particles is negative and a DC voltage superimposed with an AC voltage is applied to both the developer supporting member 11 and the opposite polarity particle recovery member 22, then, only a DC voltage superimposed with an AC voltage with an average value higher than the average value of the DC voltage superimposed with an AC voltage applied to the developer supporting member 11 is applied to the opposite polarity particle recovery member 22. At these times, the maximum value of the potential difference between the voltage (DC+AC) applied to the developer supporting member 11 and the voltage (DC+AC) applied to the opposite polarity particle recovery member 22 divided by the gap at the closest point between the opposite polarity particle recovery member 22 and the developer supporting member 11 is the maximum value of the absolute value of the opposite polarity particle separation electric field which is caused also by the differences in the amplitude, phase, frequency, and duty ratio of the voltages, and it is desirable that this value is within the above range.

The opposite polarity particles on the opposite polarity particle recovery member 22 that were separated and collected by that member are recovered into the developer tank 16. At the time of recovering the opposite polarity particles from the opposite polarity particle recovery member 22 to the developer tank 16, it is sufficient to reverse the magnitude relationship between the average value of the voltage applied to the opposite polarity particle recovery member 22 and the average value of the voltage applied to the developer supporting member 11, it is possible to carry this out during the timing of non-image formation such as before starting image formation or after the end of image formation, or in between image formation of sheets during continuous operation (between sheets).

The opposite polarity particle recovery member 22 can be made of any material as long as the above voltage can be applied to it, and for example, it is possible to use an aluminum roller to which surface treatment has been made. Apart from that, on top of a conductive base body such as aluminum it is also possible to provide a resin coating of, for example, polyester resin, polycarbonate resin, acrylic resin, polyethylene resin, polypropylene resin, urethane resin, polyamide resin, polyimide resin, poly-sulfone resin, polyether ketone resin, polyvinyl chloride resin, vinyl acetate resin, silicone resin, or fluorocarbon resin, or to provide a rubber coating of, for example, silicone rubber, urethane rubber, nitrile rubber, natural rubber, isoprene rubber, etc. The coating materials are not restricted to these. In addition, it is possible to add conductive material either in the bulk or on the surface of the above coatings. The conductive material can be an electronic conductive material or an ionic conductive material. The electronic conductive materials can be carbon black such as Ketzin black, acetylene black, furnace black, etc., or metal powder, or fine particles of metallic oxides, but the conductive material is not restricted to these. The ionic conductive materials can be cationic compounds such as quaternary ammonium salts, or amphoteric compounds, or other ionic polymer materials, but are not restricted to these. In addition, it can also be a conductive roller made of a metallic material such as aluminum, etc.

The developer supporting member 11 is made of a magnet roller 13 which is placed in a fixed manner, and a sleeve roller 12 that is free to rotate and that encircles the magnet roller 13. The magnet roller 13 has five magnetic poles N1, S1, N3, N2, and S2 along the direction of rotation B of the sleeve roller 12. Among these magnetic poles, the main magnetic pole N1 is placed in the development area 6 opposite the image carrier 1, and the same polarity poles N3 and N2 that generate the repulsive magnetic field for separating the developer 24 on the sleeve roller 12 are placed in opposite positions in the interior of the developer tank 16.

The developer tank 16 is formed from a casing 18, and normally, it has inside it a bucket roller 17 for feeding the developer to the developer supporting member 11. At the position of the casing 18 opposite the bucket roller 17, desirably, an ATDC (Automatic Toner Density Control) sensor 20 is placed for detecting the ratio of the toner density within the developer.

Normally, the development apparatus 2*a* has a replenishment section 7 for replenishing into the developer tank 16 the quantity of toner that is consumed in the development area 6, and a regulating member 15 (regulating blade) for making a thin layer of the developer in order to regulate the quantity of developer on the developer supporting member 11. The replenishment section 7 is made of a hopper 21 storing the replenishment toner (supply toner) 23, and a replenishment roller 19 for replenishing the toner to the interior of the developer tank 16.

As the replenishment toner 23, it is desirable to use a toner with the opposite polarity particles added as external additives. By using a toner to which external addition of opposite polarity particles has been made, it is possible to compensate effectively for the reduction in the charge bearing property of the carrier that deteriorates gradually due to wearing out. The amount of external addition of opposite polarity particles in the replenishment toner 23 should desirably be in the range of 0.1 to 10.0% by mass with respect to the toner, and particularly desirably be in the range of 0.5 to 5.0% by mass.

The external additives for the replenishment toner have the purpose of giving various properties required of a toner such as charging control, fluidity control, adhesive force control, etc., and it is also possible to use particles other than the opposite polarity particles. At that time, from the point of view of acquiring charging properties of the toner, it is desirable to add as the external additive other than the opposite polarity particles mainly same polarity particles that get charged with the same polarity as the toner.

When the toner is a positively charging toner, fine particles with the property of being charged positively are used as the same polarity particles. For example, it is possible to use inorganic particles such as strontium titanate, barium titanate, alumina, etc., or to use particles made of thermoplastic resins or thermosetting resins such as acrylic resin, benzoguanamine resin, nylon resin, polyimide resin, polyamide resin, etc. In addition, it is possible to include in the resin some positive charging control agents that apply positive charge, or it is possible to configure nitrogen containing copolymers. Here, as the positive charging control agent, it is possible to use, for example, nigrosine dye, quaternary ammonium salts, etc., and also, as the above nitrogen containing monomer, it is possible to use 2-methyl amino ethyl acrylate, 2-diethyl amino ethyl acrylate, 2-methyl amino ethyl methacrylate, 2-diethyl amino ethyl methacrylate, vinyl pyridine, N-vinyl carbazole, vinyl imidazole, etc.

On the other hand, when a negatively charging toner is being used, fine particles that are charged negatively are used as the same polarity particles. For example, inorganic particles such as silica, titanium dioxide, etc., are added and fine particles constituted from thermosetting resins or thermoplastic resins such as resins containing fluorine, polyolefin resins, silicone resins, polyester resins, etc. are used, or else, it is also possible to include in the resins a negatively charging control agent gives negative charging property to the resin, or to constitute using copolymers of acrylic type monomers containing fluorine, or methacrylate type monomers containing fluorine. Here, as the above negatively charging control agent, it is possible to use, for example, salicylate types, naphthol type chrome complex, aluminum complex, iron complex, zinc complex, etc.

Further, in order to control the charging property and the hydrophobicity of same polarity particles, it is also possible to carry out surface treatment of the surface of the inorganic fine particles using a silane coupling agent, a titanium coupling agent, silicone oil, etc., and in particular, when giving positive charging property to the inorganic fine particles, it is desirable to carry out surface treatment with a coupling agent having an amino radical, or when giving negative charging property it is desirable to carry out surface treatment using a coupling agent having a fluorine radical.

For the processing of adding external additives of opposite polarity particles and same polarity particles, it is desirable to carry out external additive addition processing of opposite polarity particles after the external additive addition processing of same polarity particles. By doing so, after first strongly attaching to the toner the same polarity particles that are related to carrier deterioration during the first external additive addition processing it is possible to adhere on the surface of the toner the opposite polarity particles with an appropriate strength.

In the development apparatus 2*a* shown in FIG. 1, in detailed terms, the developer 24 inside the developer tank 16 is mixed and stirred by the rotation of the bucket roller 17, and after being charged due to friction, it is scooped up by the bucket roller 17 and is fed to the sleeve roller 12 on the surface of the developer supporting member 11. This developer 24 is held on the surface of the sleeve roller 12 due to the magnetic force of the magnet roller 13 inside the developer supporting member 11 (development roller), rotates and moves along with the sleeve roller 12, and has its passage amount regulated by the regulating member 15 provided opposite to the development roller 11. Thereafter, in the part opposite to the opposite polarity particle recovery member 22, as has been explained earlier, only the opposite polarity particles in the developer are separated selectively and are collected on the opposite polarity particle recovery member 22. The remaining developer from which the opposite polarity particles are separated is conveyed to the development area 6 that is opposite the image carrier 1. In the development area 6, bristles are formed in the developer because of the magnetic force of the main magnetic pole N1 of the magnet roller 13, and because of the force applied on the toner by the electric field formed between the electrostatic latent image on the image carrier 1 and the development roller 11 to which a development bias has been applied, the toner in the developer moves to the electrostatic latent image on the image carrier 1, and hence the electrostatic latent image is developed into a visible image. The development method can also be a reversal development method or can be a normal development method. The developer 24 which has consumed the toner in the development area 6 is conveyed towards the developer tank 16, and is peeled off from the developer supporting member 11 due to the repulsive magnetic field of the identical polarity poles N3 and N2 of the magnet roller provided opposite to the bucket roller 17, and is recovered into the developer tank 16. When the replenishment control section not shown in the figure but provided in the replenishment section 7 detects from the output value of the ATDC sensor 20 that the toner density in the developer 24 has fallen below the minimum toner density necessary for achieving the image density, it sends the drive start signal to the drive section of the toner replenishment roller 19. Thereafter, the rotation of the toner replenishment roller 19 starts, and due to this rotation, the replenishment toner 23 accumulated inside the hopper 21 is fed to the interior of the developer tank 16. On the other hand, the opposite polarity particles collected by the opposite polarity particle recovery member 22 are returned to the surface of the development roller due to reversing the direction of the electric field applied to the development roller and the opposite polarity particle recovery member 22 during the non-image forming period, and conveyed along with the developer due to the rotation of the development roller and are returned to the developer tank.

In FIG. 1, although the opposite polarity particle recovery member 22 has been provided separately from the regulating member 15 or the casing 26, the opposite polarity particle recovery member 22 can double as at least one of the regulating member 15 and the casing 26. In other words, it is possible to use at least one of the regulating member 15 and the casing 26 as the opposite polarity particle recovery member 22. In that case, it is sufficient to apply the opposite polarity particle separation bias to the regulating member 15 or to the casing 26 as an electric field forming member. Because of this, it is possible to realize space reduction and lower cost.

In the development apparatus 2*a*, it is not necessary that all the opposite polarity particles should be recovered by the opposite polarity particle recovery member 22, but it is acceptable that a part of the opposite polarity particles are not recovered but are offered for development along with the toner and are consumed there. The other part of the opposite polarity particles is recovered, and since even replenishment of opposite polarity particles is made, even if the opposite polarity particles cannot be recovered completely, the effect of supplementing carrier charging is obtained. At this time, it is desirable that the separation rate of opposite polarity particles is in the range of 9.3% to 50.3%. If the separation rate is too low, the recoverability of opposite polarity particles becomes poor, and the effect of suppressing the carrier deterioration due to the opposite polarity particles becomes weaker. If the separation rate is too high, although the effect of suppressing the carrier deterioration is obtained sufficiently, the recovered opposite polarity particles get adhered excessively to the toner in the developer as a result of which the amount of charging of the toner decreases.

Figure 2:
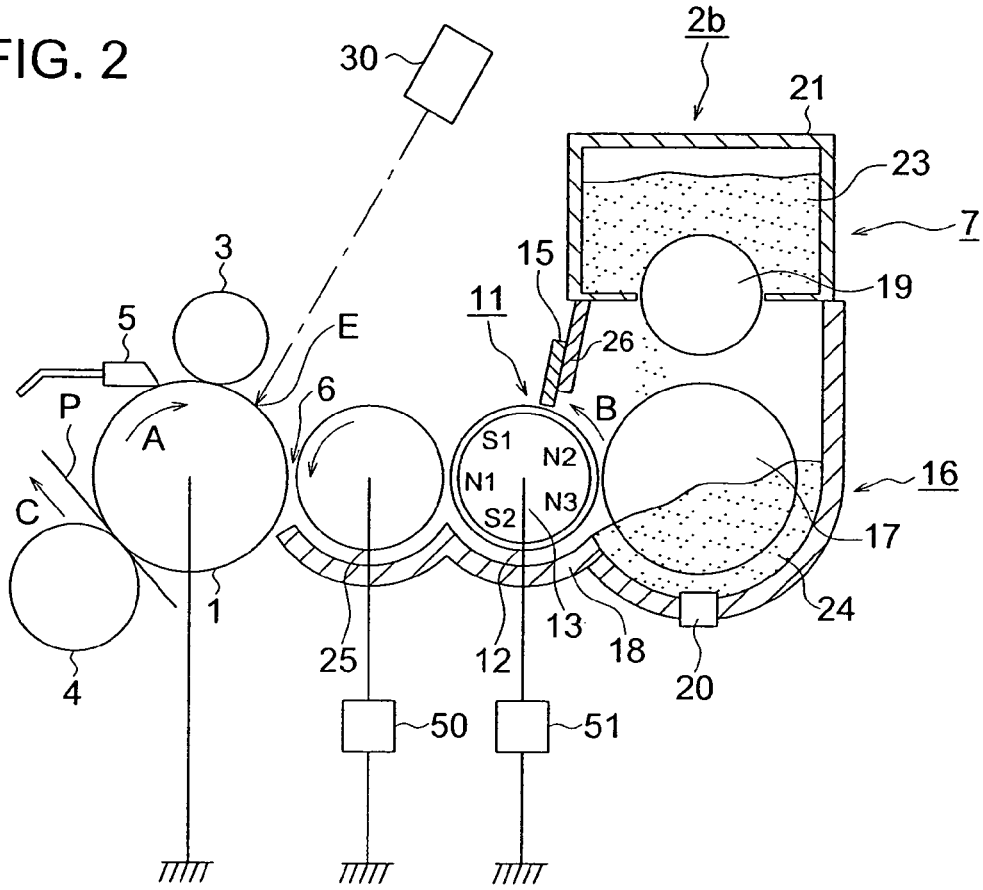
FIG. 2 is an outline configuration diagram showing the important part of an image forming apparatus according to another preferred embodiment of the present invention.

Next, the important parts of an image forming apparatus having a development apparatus according to another preferred embodiment of the present invention are shown in FIG. 2. In FIG. 2, the members that function in a manner similar to the corresponding member in FIG. 1 are assigned the same numeric symbols and their detailed explanation is omitted here.

The development apparatus 2*b* shown in FIG. 2 uses as a separation mechanism that separates toner or opposite polarity particles from the developer on the developer supporting member 11, instead of the opposite polarity particle recovery member 22 shown in FIG. 1, a toner supporting member 25 that separates and carries the toner from the developer on the developer supporting member 11. The toner supporting member 25, as is shown in FIG. 2, is provided between the developer supporting member 11 and the image carrier 1, and electrically separates and carries the toner from the developer on the developer supporting member 11 due to the application of the toner separation bias. The toner separated and carried by the toner supporting member 25 is conveyed by that toner supporting member 25, and develops the electrostatic latent image on the image carrier 1 in the development area 6.

In this manner, in the development apparatus 2*b*, unlike in the preferred embodiment shown in FIG. 1, not the opposite polarity particles are separated from the developer, but the toner in the developer is separated and carried by the toner supporting member 25, and the toner separated and carried by that toner supporting member 25 is provided for the development of the electrostatic latent image on the image carrier 1.

The toner supporting member 25 is connected to the power supply 50, a prescribed toner separation bias is applied, and the developer supporting member 11 is connected to the power supply 51. Because of this, the toner in the developer is separated electrically, and is carried on the surface of the toner supporting member 25.

The toner separation bias voltage applied to the toner supporting member 25 differs depending on the charging polarity of the toner, that is, when the toner is charged negatively, it is a higher average voltage than the average value of the voltage applied to the developer supporting member 11, and when the toner is charged positively, it is a lower average voltage than the average value of the voltage applied to the developer supporting member 11. Whether the toner is charged to positive polarity or to negative polarity, it is desirable that the difference between the average voltage applied to the toner supporting member 25 and the average voltage applied to the developer supporting member 11 is 20 to 500 V, and more desirably 50 to 300 V. If the potential difference is too small, the quantity of toner on the toner supporting member 25 will be small and it will not be possible to obtain sufficient image density. On the other hand, if the potential difference is too large, the toner supply will be excessive, and there is the likelihood of an increase in the wasteful consumption of toner.

In the development apparatus 2*b*, in addition, it is desirable that an alternating electric field is formed between the toner supporting member 25 and the developer supporting member 11. Since the toner makes reciprocating movement due to the formation of an alternating electric field, it is possible to separate effectively the toner and the opposite polarity particles. At this time, it is desirable that an electric field with a maximum value of $2.5\times10^6$ V or more and $5.5\times10^6$ V/m or less is formed. By forming an electric field of more than $2.5\times10^6$ V/m, it becomes possible to separate the opposite polarity particles from the toner also due to the electric field, and it is possible to improve still further the separation of the toner. Further, it is not desirable to use an electric field of more than $5.5\times10^6$ V/m because a leakage occurs between the toner supporting member 25 and the developer supporting member 11.

In the present patent specifications, the electric field formed between the toner supporting member 25 and the developer supporting member 11 is called the toner separation electric field. Normally, such a toner separation electric field is obtained by applying an alternating voltage to either one or both of the toner supporting member 25 and the developer supporting member 11. In particular, when an alternating voltage is applied to the toner supporting member 25 for developing the electrostatic latent image using the toner, it is desirable to form the toner separation electric field using the alternating voltage applied to the toner supporting member 25. At this time, it is sufficient if the maximum value of the absolute value of the toner separation electric field is within the above range.

For example, if the charging polarity of the toner is positive and a DC voltage superimposed with an AC voltage is applied to the developer supporting member 11, and only a DC voltage is applied to the toner supporting member 25, then, only a DC voltage lower than the average value of the voltage (AC+DC) applied to the developer supporting member 11 is applied to the toner supporting member 25. Furthermore, for example, if the charging polarity of the toner is negative and a DC voltage superimposed with an AC voltage is applied to the developer supporting member 11, and only a DC voltage is applied to the toner supporting member 25, then, only a DC voltage higher than the average value of the voltage (AC+DC) applied to the developer supporting member 11 is applied to the toner supporting member 25. At these times, the maximum value of the absolute value of the toner separation electric field is the maximum value of the potential difference between the voltage (AC+DC) applied to the developer supporting member 11 and the DC voltage applied to the toner supporting member 25 divided by the gap at the closest point between the toner supporting member 25 and the developer supporting member 11, and it is desirable that this value is within the above range.

Furthermore, for example, if the charging polarity of the toner is positive and only a DC voltage is applied to the developer supporting member 11, and a DC voltage superimposed with an AC voltage is applied to the toner supporting member 25, then, a DC voltage superimposed with an AC voltage with an average value lower than the DC voltage applied to the developer supporting member 11 is applied to the toner supporting member 25. Furthermore, for example, if the charging polarity of the toner is negative and only a DC voltage is applied to the developer supporting member 11, and a DC voltage superimposed with an AC voltage is applied to the toner supporting member 25, then, only a DC voltage superimposed with an AC voltage with an average value higher than the value of the DC voltage applied to the developer supporting member 11 is applied to the toner supporting member 25. At these times, the maximum value of the absolute value of the opposite polarity separation electric field is the maximum value of the potential difference between the DC voltage applied to the developer supporting member 11 and the voltage (DC+AC) applied to the toner supporting member 25 divided by the gap at the closest point between the toner supporting member 25 and the developer supporting member 11, and it is desirable that this value is within the above range.

Furthermore, for example, if the charging polarity of the toner is positive and a DC voltage superimposed with an AC voltage is applied to both the developer supporting member 11 and the toner supporting member 25, then, a DC voltage superimposed with an AC voltage with an average value lower than the average value of the DC voltage superimposed with an AC voltage applied to the developer supporting member 11 is applied to the toner supporting member 25. Furthermore, for example, if the charging polarity of the toner is negative and a DC voltage superimposed with an AC voltage is applied to both the developer supporting member 11 and the toner supporting member 25, then, only a DC voltage superimposed with an AC voltage with an average value higher than the average value of the DC voltage superimposed with an AC voltage applied to the developer supporting member 11 is applied to the toner supporting member 25. At these times, the maximum value of the potential difference between the voltage (DC+AC) applied to the developer supporting member 11 and the voltage (DC+AC) applied to the toner supporting member 25 divided by the gap at the closest point between the toner supporting member 25 and the developer supporting member 11 is the maximum value of the absolute value of the toner separation electric field which is caused also by the differences in the amplitude, phase, frequency, and duty ratio of the voltages, and it is desirable that this value is within the above range.

The developer remaining on the developer supporting member 11 after the toner in it has been removed by the toner supporting member 25, that is, the carrier and the opposite polarity particles, are conveyed as they are by that developer supporting member 11 and are recovered into the developer tank 16. In the present preferred embodiment, after toner separation, since the opposite polarity particles are recovered as they are by the developer supporting member 11 into the interior of the developer tank 16, it is possible to omit the process, described in the preferred embodiment of FIG. 1, of returning the opposite polarity particles accumulated by the opposite polarity particle recovery member 22 to the developer tank during the non-image formation period.

The toner supporting member 25 can be made of any material as long as the above voltage can be applied to it, and for example, it is possible to use an aluminum roller to which surface treatment has been made. Apart from that, on top of a conductive base body such as aluminum it is also possible to provide a resin coating of, for example, polyester resin, polycarbonate resin, acrylic resin, polyethylene resin, polypropylene resin, urethane resin, polyamide resin, polyimide resin, poly-sulfone resin, polyether ketone resin, polyvinyl chloride resin, vinyl acetate resin, silicone resin, or fluorocarbon resin, or to provide a rubber coating of, for example, silicone rubber, urethane rubber, nitrile rubber, natural rubber, isoprene rubber, etc. The coating materials are not restricted to these. In addition, it is possible to add conductive material either in the bulk or on the surface of the above coatings. The conductive material can be an electronic conductive material or an ionic conductive material. The electronic conductive materials can be carbon black such as Ketzin black, acetylene black, furnace black, etc., or metal powder, or fine particles of metallic oxides, but the conductive material is not restricted to these. The ionic conductive materials can be cationic compounds such as quaternary ammonium salts, or amphoteric compounds, or other ionic polymer materials, but are not restricted to these. In addition, it can also be a conductive roller made of a metallic material such as aluminum, etc.

In the development apparatus 2*b* shown in FIG. 2, in detailed terms, the developer 24 inside the developer tank 16 is mixed and stirred by the rotation of the bucket roller 17, and after being charged due to friction, it is scooped up by the bucket roller 17 and is fed to the sleeve roller 12 on the surface of the developer supporting member 11. This developer 24 is held on the surface of the sleeve roller 12 due to the magnetic force of the magnet roller 13 inside the developer supporting member 11 (development roller), rotates and moves along with the sleeve roller 12, and has its passage amount regulated by the regulating member 15 provided opposite to the development roller 11. Thereafter, in the part opposite to the toner supporting member 25, as has been explained earlier, only the toner in the developer is separated selectively and is collected on the toner supporting member 25. The separated toner is conveyed to the development area 6 that is opposite to the image carrier 1. In the development area 6, because of the force applied on the toner by the electric field formed between the electrostatic latent image on the image carrier 1 and the toner supporting member 25 to which a development bias has been applied, the toner on the toner supporting member 25 moves to the electrostatic latent image on the image carrier 1, and hence the electrostatic latent image is developed into a visible image. The development method can also be a reversal development method or can be a normal development method. The toner layer on the toner supporting member 25 that has passed through the development area 6 is conveyed to the development area after passing through toner supply and recovery of the magnetic brush in the opposing part between the toner supporting member 25 and the developer supporting member 11. On the other hand, the developer remaining on the developer supporting member 11 from which the toner has been separated, is conveyed as it is towards the developer tank 16, and is peeled off from the developer supporting member 11 due to the repulsive magnetic field of the identical polarity poles N3 and N2 of the magnet roller provided opposite to the bucket roller 17, and is recovered into the developer tank 16. When the replenishment control section not shown in the figure but provided in the replenishment section 7, as in FIG. 1, detects that the toner density in the developer 24 has fallen below the minimum toner density necessary for achieving the image density, it sends the drive start signal to the drive section of the toner replenishment roller 19, and the replenishment toner 23 is supplied to the interior of the developer tank 16.

In the development apparatus 2*b*, it is not necessary that all the opposite polarity particles should be recovered by the opposite polarity particle recovery member, but it is acceptable that a part of the opposite polarity particles are not recovered but are offered for development along with the toner and are consumed there. The other part of the opposite polarity particles is recovered, and since even replenishment of opposite polarity particles is made, even if the opposite polarity particles cannot be recovered completely, the effect of supplementing carrier charging by the opposite polarity particle is obtained. At this time, it is desirable that the separation rate of opposite polarity particles is in the range of 9.3% to 50.3%. If the separation rate is too low, the recoverability of opposite polarity particles becomes poor, and the effect of suppressing the carrier deterioration due to the opposite polarity particles becomes weaker. If the separation rate is too high, although the effect of suppressing the carrier deterioration is obtained sufficiently, the recovered opposite polarity particles get adhered excessively to the toner in the developer as a result of which the amount of charging of the toner decreases.

According to the preferred embodiments of the present invention, a developer having opposite polarity particles that get charged to a polarity opposite to the polarity of charging of the toner is used, and a development apparatus is used that is provided with a separation mechanism that separates the toner or the opposite polarity particles from the developer. When the separation mechanism separates opposite polarity particles, the separated opposite polarity particles are temporarily accumulated in the separation mechanism, and thereafter recovered into the developer. On the other hand, when the separation mechanism separates the toner, since only the toner after separating the opposite polarity particles is used for developing the electrostatic latent image on the image carrier, the discharge of opposite polarity particles from the developer is suppressed. Because of this, the consumption of the opposite polarity particles is suppressed without being dependent on the image area ratio, and hence sufficient amount of opposite polarity particles are always present within the developer, and it becomes possible to realize effective adhesion of the opposite polarity particles on to the surface of the carrier during high-volume printing. At this time, by making the average value of the surface charge density of the opposite polarity particles to be in the range of 0.5 to 3.0 times the average value of the surface charge density of the carriers in the developer, even if spent matter on the toner base material or the post processing agent on the carrier is generated depending on the number of pages printed, the effect of compensating for the charge applying property of the carrier is obtained sufficiently due to the adhesion of opposite polarity particles on to the carrier, and the charge applying property of the carrier is maintained close to the initial state. As a result, it is possible to suppress over a long time the deterioration of the carrier, and to realize stable toner charging amount during high-volume printing, and hence it is possible to achieve a long life of the development apparatus.

Further, in the hybrid development method, while the toner is supplied on to the surface of the toner supporting member by the magnetic brush due to an electric field, because of the toner supplying electric field at that time, the opposite polarity particles that are charged to a polarity opposite to the charge on the toner are subjected to a force in the direction of making them return to the magnetic brush. Therefore, by using a development apparatus of the hybrid development method, it is possible to use the toner from which the opposite polarity particles have been separated as the toner on the toner supporting member, and as a result, it is possible to develop the electrostatic latent image using the toner from which the opposite polarity particles have been separated. Because of this fact, in a hybrid development method, without providing a special separation mechanism for separating the opposite polarity particles and without providing a process of returning the captured opposite polarity particles into the developer tank, it is possible to suppress the consumption of the opposite polarity particles, and it is possible to provide a development apparatus and development method having a compact and low cost configuration, and that can form stable images over a long time.

EXAMPLES

In the following, some examples of implementation of a development apparatus in an image forming apparatus using the electro-photographic method with the present invention being applied are explained.

Experimental Example 1

A print durability test was conducted using a development apparatus having the configuration shown in FIG. 1. The numeral 22 in this figure indicates a separation and recovery roller for separating the opposite polarity particles. The developer used had a carrier for the bizhub C350 manufactured by Konica-Minolta Business Technologies Co. Ltd., (volume average particle diameter of about 33 μm) and ten types of toners manufactured according to the following method. The method of manufacturing the toner was taking 100 parts by mass of toner base material with a particle diameter of about 6.5 μm manufactured by the wet type particle manufacturing method, and carrying out external addition processing of, as the external additive a, 0.6 parts by mass of hydrophobic silica with an number average primary particle diameter of 20 nm to which surface treatment was made using hexamethyldisilazane (HMDS) which is a hydrophobizing agent, and as the external additive b, 0.6 parts by mass of anatase type titanium dioxide with a number average primary particle diameter of 30 nm to which surface treatment was made in an aqueous wet atmosphere using isobutyltrimethoxysilane which is a hydrophobizing agent, and these were subjected to surface treatment using a Henschel mixer (manufactured by Mitsui Metal Mining Corp.) for 2 minutes at a speed of 40 m/s. Among the types of toners listed in Table 1, the toners without opposite polarity particles are the toners obtained using the method up to here. For the other toners, as the toners to which this external addition processing is made further, as the external additive c which is the opposite polarity particle, strontium titanate with a number average particle diameter of 350 nm was subjected to the different surface treatments shown in Table 1. The following surface treatments were used for the opposite polarity particles. In the table, those indicated as fluorine based silicon oil indicate that the strontium titanate was treated with fluorine based silicon oil of the prescribed amount indicated, in the table using the dry type method. Further, the items indicated as di-methyl polysiloxane indicate that the strontium titanate was surface-treated with di-methyl poly-siloxane of the prescribed amount indicated in the table using the wet type method. Further, the items indicated as wet type i-butylmethoxysilane/wet type aminosilane indicate that the strontium titanate was surface-treated with i-butylmethoxysilane and aminosilane of the prescribed amounts of additives indicated in the table using the wet type method. Further, the items indicated as di-methyl poly-siloxane/dry type aminosilane indicate that the strontium titanate was surface-treated with di-methyl poly-siloxane of the prescribed amount of additive indicated in the table using the wet type method with and, after that, surface-treated with aminosilane of the prescribed amount of additive indicated in the table using the dry type method. Further, the items indicated as wet type i-butylmethoxysilane/dry type aminosilane indicate that the strontium titanate was surface-treated with i-butylmethoxysilane of the prescribed amount of additive indicated in the table using the wet type method and, after that, surface-treated with aminosilane of the prescribed amount of additive indicated in the table using the dry type method. Here, dry type method is the method of diluting the hydrophobizing agent with a solvent, adding and mixing this diluted liquid to the opposite polarity particles, heating and drying this mixture, and then grinding it. The wet type method is the method of dispersing the opposite polarity particles in a water based system making it into a slurry, adding and mixing the hydrophobizing agent, heating and drying this mixture, and then grinding it. This external additive c which is the opposite polarity particle is added at the rate of 2 parts by mass for every 100 parts by mass of the toner base material, and the toner was obtained by carrying out external addition processing for 20 minutes at a speed of 40 m/s using a Henschel mixer. Further, the ratio of the toner within the developer was set as 8% by mass. However, the toner ratio is the ratio of the total quantity of the toner, post-processing agent, and of the opposite polarity particles to the total quantity of the developer (the same is true hereafter).

A rectangular wave development bias voltage having an amplitude of 1.4 kV, a DC component of −400 V, a duty ratio of 50%, and a frequency of 2 kHz was applied to the developer supporting member. A DC bias of −550 V was applied to the opposite particle recovery member so that it has a potential difference of −150 V with respect to the average potential of the development bias and a potential difference of 850 V with the maximum potential of the development bias. An aluminum roller with alumite treatment given on its surface was used as the opposite polarity particle recovery member, and the gap at the nearest point between the developer supporting member and the opposite polarity particle recovery member was kept at 0.3 mm. The potential of the background part of the electrostatic latent image formed on the image carrier was −550 V and the image part potential was −60 V. The gap at the closest point between the image carrier and the developer supporting member was set to be 0.35 mm. The maximum value of the absolute value of the opposite polarity particle separation electric field formed between the developer supporting member and the opposite polarity particle recovery member was 850 V/0.3 mm=$2.8\times10^6$ V/m. The recovery of the opposite polarity particles accumulated by the opposite polarity particle recovery member to the developer tank was made during the timing between sheets, and this was done by reversing the voltages applied to the developer supporting member and the opposite polarity particle recovery member.

The measurement of the surface charge density of the carrier and the opposite polarity particles was made for the developers in which the different toners were mixed using the surface density measurement method described elsewhere in this document, how many times the surface charge density of the opposite polarity particles is relative to the surface charge density of the carriers was calculated, and the results are shown in Table 1.

The amounts of toner charge during the print durability test are shown in Table 1. In Table 1, in order to indicate the extent of changes in the charge application property, it is indicated as A when the absolute value of the change in the amount of toner charge at the point after 50 k sheets or after 100 k sheets with respect to the initial condition is in the range of 0 to 5 μC/g, as B when it is in the range of 5 to 10 μC/g, and as D when it is above 10 μC/g.

TABLE 1

| | Opposite polarity particles | | | Ratio with carrier surface | Amount of toner charging (-μC/g) | | | | | Change of amount of toner charging (-μC/g) | | Carrier charge maintenance | |
|---|---|---|---|---|---|---|---|---|---|---|---|---|---|
| | Surface treatment | *1 | *2 | charge density | 0k | 10k | 30k | 50k | 100k | 50k | 100k | 50k | 100k |
| E. 1-1 | Fluorine based silicone oil | 1.6 | 0.5 | 0.5 | 36.1 | 32.3 | 30.1 | 28.2 | 25.3 | −7.9 | −10.8 | B | D |
| E. 1-2 | Fluorine based silicone oil | 2 | 1.0 | 1.2 | 36.1 | 34.4 | 35.2 | 36.3 | 35.6 | 0.2 | −0.5 | A | A |
| E. 1-3 | Di-methyl poly-siloxane | 0.6 | 1.2 | 1.3 | 35.6 | 33.8 | 36.4 | 35.6 | 34.2 | 0.0 | −1.4 | A | A |
| E. 1-4 | *3 | 3/3 | 2.0 | 2.2 | 34.3 | 36.2 | 36.5 | 37.2 | 38.5 | 2.9 | 4.2 | A | A |
| E. 1-5 | Fluorine based silicone oil | 3 | 2.7 | 3.0 | 33.6 | 34.5 | 39.2 | 40.7 | 45.6 | 7.1 | 12.0 | B | D |
| C. 1-1 | Fluorine based silicone oil | 0.3 | −2.2 | −2.5 | 39.3 | 25.5 | 18.8 | 15.2 | — | −24.1 | — | D | D |
| C. 1-2 | Fluorine based silicone oil | 1.2 | −0.5 | −0.6 | 36.9 | 28.0 | 24.0 | 22.9 | — | −14.0 | — | D | D |
| C. 1-3 | Di-methyl poly-siloxane/dry type aminosilane | 0.6/3 | 3.5 | 3.9 | 32.6 | 37.2 | 41.1 | 44.4 | — | 11.8 | — | D | D |

TABLE 1-continued

| | Opposite polarity particles | | | Ratio with carrier surface | Amount of toner charging (-μC/g) | | | | | Change of amount of toner charging (-μC/g) | | Carrier charge maintenance | |
|---|---|---|---|---|---|---|---|---|---|---|---|---|---|
| | Surface treatment | *1 | *2 | charge density | 0k | 10k | 30k | 50k | 100k | 50k | 100k | 50k | 100k |
| C. 1-4 | Wet type i-butylmethoxy-silane/dry type aminosilane | 3/3 | 4.0 | 4.4 | 31.7 | 41.8 | 42.4 | 46.3 | — | 14.6 | — | D | D |
| C. 1-5 | | — | — | — | 34.7 | 29.1 | 24.5 | 21.8 | — | −12.9 | — | D | D |

Here "—" indicates that measurement was not made,
*1: Amount of surface treatment
E.: Example,
C.: Comparison example,
*2: Surface charge density ($\times 10^{-4}$ C/m$^2$),
*3: Wet type i-butylmethoxy-silane/wet type aminosilane From the results of Table 1, it can be seen that, since the surface charge density of the opposite polarity particles in the developer is in the range of 0.5 to 3.0 times the surface charge density of the carrier in the developer, the effect of supplementing the charge applying property of the carrier due to the adhesion of the opposite polarity particles is brought out sufficiently, and the charge applying property of the carriers is maintained near the initial state. As a result, it was possible to suppress the change in the amount of toner charge from the initial condition within the range of 0 to 10 μC/g at the point of 50 k sheets of printing, and there was no occurrence of problems associated with decrease in the toner charge such as increase in the fogging of the background or toner splashing within the apparatus, or of problems associated with increase in the toner charge such as reduction in the density or deterioration of the dot reproducibility. In particular, by making the surface charge density of the opposite polarity particles in the developer to be in the range of 1.2 to 2.2 times the surface charge density of the carrier in the developer, there is almost no change in the amount of toner charge with increase in the number of printed sheets, and it is possible to suppress it to within the range of 0 to 5 μC/g even at the point after 100 k pages of printing, and it is clear that good images can be formed over a long time and it is possible to achieve a long life of the development apparatus.

Further, the following method was used for the measurement of the surface charge density of the carriers and the opposite polarity particles.

(Method of Measuring Carrier Surface Charge Density)

Considering that the carrier is a sphere, the surface charge density σ of the carrier is obtained by Equation 1 given below. In this equation, d is the particle diameter of the carrier, ρ is the density of a carrier particle, M is the mass of the carrier, and Q is the amount of electrical charge on the carrier.

Among these, the amount of electrical charge on the carrier and the carrier mass were measured as follows using the apparatus of FIG. 3. In this figure, the numeric symbol 32 refers to a magnet roller, 31 is a conductive sleeve provided so that it can rotate freely with respect to the magnet roller 32 in the circumferential direction, and 34 is a metallic conductive electrode. An unused developer before print durability test whose mass has been measured in advance is adhered evenly by magnetic force on the sleeve roller, and the application of a voltage and the rotation of the magnet roller is started by operating a switch not shown in the figure. The spacing between the surface of the sleeve roller and the electrode 34 was 2 mm and the voltage applied was 2 kV. As a result, all the toners in the developer got separated from the carriers and moved to the side of the conductive electrode indicated by 34. Further, the maximum value of the absolute value of the electric field formed between the surface of the sleeve roller and the electrode 34 was 2000V/2 mm=$1.0\times10^6$ V/m, and at this magnitude of the electric field, the opposite polarity particles adhered to the toner cannot get separated from the toner, and move along with the toner to the side of the electrode 34.

The amount of electric charge stored in the capacitor 35 is the amount of electric charge induced due to the movement of the toner and the opposite polarity particles adhered to the toner on to the surface of the electrode 34. On the other hand, since the total electric charge on the developer is zero, the absolute value of this amount of charge is also equal to the absolute value of the electric charge that carrier had in the developer. Therefore, the electric charge on the capacitor 35 is equal to the electric charge that the carrier had in the developer.

Using this method, the variation of Vm before and after the movement of the toner is measured, and the amount of charge that the carrier had in the developer is calculated from the product of the variation of Vm and the capacitance of the capacitor 35. In addition, the mass of the carrier was measured by subtracting the mass of the toner and the opposite polarity particles that moved to the electrode side from the initial mass of the developer. On the other hand, the number average particle diameter of the carrier was obtained using a Coulter counter TA-II, and this was taken as the particle diameter of the carrier. The particle density of the carrier was obtained by the method of immersion in a liquid. These values are substituted in Equation 1 and the surface charge density of the carrier was calculated.

$$\sigma = \frac{1d\rho Q}{6M} \qquad \text{Equation 1}$$

(Method of Measuring Surface Charge Density of Opposite Polarity Particles)

On the other hand, even for the surface charge density of the opposite polarity particles, similar to the case of the carriers, it is possible to obtain it from the particle diameter d of the opposite polarity particles, the density ρ of the opposite polarity particles, the mass M of the opposite polarity particles, and the amount of electrical charge Q on the opposite polarity particles.

Among these, the amount of electrical charge on the opposite polarity particles and the mass of the opposite polarity particles were measured as follows using the apparatuses of FIG. 4 and FIG. 5. Firstly, using the apparatus of FIG. 4, the developer before print durability test was made to adhere due to magnetic force of a magnet roller 32 uniformly over the surface a conductive sleeve 31 which is provided so that it can rotate freely with respect to the magnet roller 32 in the circumferential direction, and the magnet roller 32 was rotated while applying a DC voltage from a power supply 33. A grounded conductive flat plate electrode 36 was passed under that, making the toner and the opposite polarity particles adhered to the toner in the developer to fly due to the electric field and thus a toner layer was formed on the surface of the flat plate electrode 36. The voltage applied at this time was 150 V, and the minimum distance between the surface of the conductive sleeve 31 and the top surface of the flat plate electrode 36 was 2 mm. The electric field formed at this time is small being 150V/2 mm=$0.075\times10^6$ V/m, and is such that there is no occurrence of separation of the opposite polarity particles from the toner. After the toner layer was formed, the flat plate electrode 36 was attached to the apparatus shown in FIG. 5.

Figure 5:
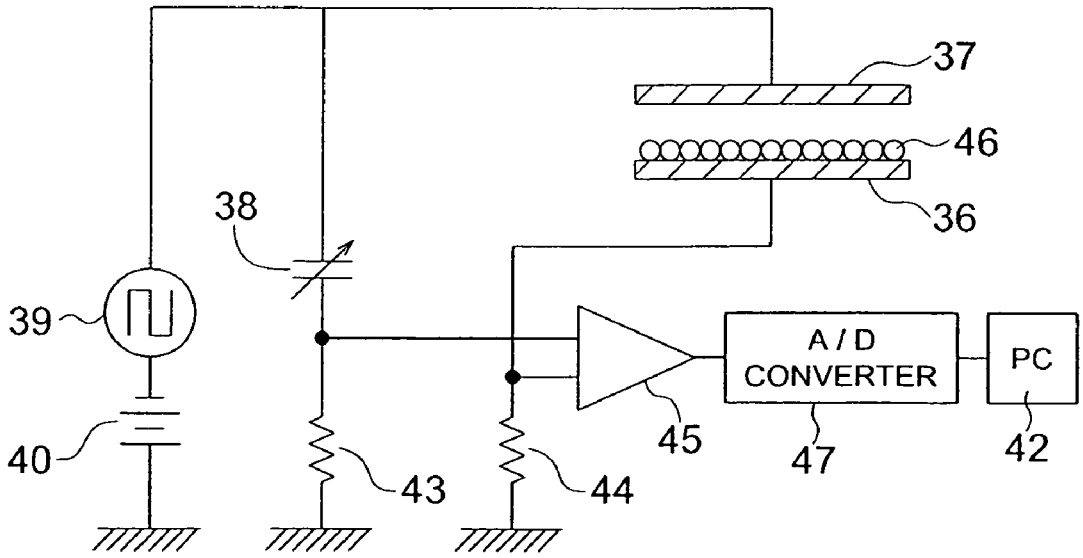
FIG. 5 is an outline configuration diagram showing a part of the apparatus for measuring the surface charge density.

The apparatus shown in FIG. 5 is one that has been shown in Japan Hardcopy 2004 Fall Meeting Collection of Papers, page 17, and is an apparatus for capturing the induced charge due to the movement of charged particles 46 between the flat plate electrodes 36 and 37. By adjusting a variable, capacitor 38 so that the capacitance between the parallel flat plate electrodes 36 and 37 and the capacitance of the variable capacitor 38 become equal, the potential difference input to a differential amplifier 45 will be proportional to the current associated with the movement of charged particles 46. By dividing the potential difference with using the values of two resistors 43 and 44 whose values are equal and known beforehand, it is possible to measure the current associated with the movement of charged particles. By integrating that current value, it is possible to measure the total amount of charge of the particles that moved from the electrode 36 to the electrode 37. The A/D converter 47 converts the output of the differential amplifier into a digital data, and PC (personal computer) 42 processes the digital data. Using this method, a voltage of −200 V DC upon which is superimposed a rectangular wave voltage with a frequency of 2 kHz and Vpp or 1400 V was obtained from the power supplies 39 and 40 and was applied between the flat plate electrodes 36 and 37 for 20 cycles, and the voltage was stopped so that the voltage before stopping was −900 V on the negative side of the applied waveform. The spacing between the parallel flat plate electrodes 36 and 37 was 150 μm. Due to the electric field formed in this manner, the opposite polarity particles get separated from the toner and after carrying out reciprocating motion in the opposite direction, stop and get adhered to the electrode 37 with the last stopping voltage. On the other hand, after reciprocating motion the toner stops and gets adhered to the electrode 36. The particles that moved from electrode 36 to electrode 37 are only the opposite polarity particles, and the amount of charge of the opposite polarity particles is obtained from the cumulative current amount from the beginning of the application of the voltage to the last stopping voltage. In addition, from the weight of the opposite polarity particles adhered on to the electrode 37, the mass of the opposite polarity particles was measured.

The particle diameter of the opposite polarity particles was measured by the method of photographing the opposite polarity particles adhered to said electrode using a scanning electron microscope (SEM) Model VE8800 manufactured by Keyence, and the particle diameter analysis of that photograph was made using the image processing software Image-Pro Plus of Media Cybernetics Inc. of USA. The SEM images were photographed until the number of particles became 300, and the number average particle diameter of the 300 particles was taken as the particle diameter of the opposite polarity particles. Further, the density of the opposite polarity particles was obtained by the liquid immersion method.

The values of the particle diameter d of the opposite polarity particles, the density ρ of the opposite polarity particles, the mass M of the opposite polarity particles, and the amount of electrical charge Q on the opposite polarity particles are substituted in Equation 1 and the surface charge density of the opposite polarity particles was calculated.

Experimental Example 2

A print durability test was conducted using a development apparatus having the configuration shown in FIG. 2. The developer used had a carrier for the bizhub C350 manufactured by Konica-Minolta Business Technologies Co. Ltd., (volume average particle diameter is about 33 μm) and a toner on which the same different types of particles were added externally as those used in Experimental Example 1 above. A DC voltage of −400V was applied to the developer supporting member. A rectangular wave development bias voltage with an amplitude of 1.6 kV, a DC component of −300 V, a frequency of 2 kHz, and a duty ratio of 50% was applied to the toner supporting member. The average voltage of the toner supporting member had a potential difference of 100 V with respect to the potential of the developer supporting member, and the maximum potential difference was 900 V. An aluminum roller with alumite surface treatment carried out on its surface was used as the toner supporting member, and the gap between the toner supporting member and the developer supporting member at the closest point was 0.3 mm. The potential of the background part of the electrostatic latent image formed on the image carrier was −550 V and the image part potential was −60 V. The gap at the closest point between the image carrier and the developer supporting member was set to be 0.15 mm. The maximum value of the absolute value of the toner separation electric field formed between the developer supporting member and the toner supporting member was 900V/0.3 mm=$3.0\times10^6$ V/m.

The amounts of toner charge during the print durability test are shown in Table 2.

TABLE 2

| | Opposite polarity particles | | | Ratio with carrier surface | Amount of toner charging (-μC/g) | | | | | Change of amount of toner charging (-μC/g) | | Carrier charge maintenance | |
|---|---|---|---|---|---|---|---|---|---|---|---|---|---|
| | Surface treatment | *1 | *2 | charge density | 0k | 10k | 30k | 50k | 100k | 50k | 100k | 50k | 100k |
| E. 2-1 | Fluorine based silicone oil | 1.6 | 0.5 | 0.5 | 36.0 | 33.7 | 29.5 | 29.8 | 24.8 | −6.2 | −11.2 | B | D |
| E. 2-2 | Fluorine based silicone oil | 2 | 1.0 | 1.2 | 36.2 | 35.6 | 35.1 | 34.9 | 35.3 | −1.3 | −0.9 | A | A |

TABLE 2-continued

| | Opposite polarity particles | | | Ratio with carrier surface | Amount of toner charging (-μC/g) | | | | | Change of amount of toner charging (-μC/g) | | Carrier charge maintenance | |
|---|---|---|---|---|---|---|---|---|---|---|---|---|---|
| | Surface treatment | *1 | *2 | charge density | 0k | 10k | 30k | 50k | 100k | 50k | 100k | 50k | 100k |
| E. 2-3 | Di-methyl poly-siloxane | 0.6 | 1.2 | 1.3 | 35.4 | 33.3 | 36.9 | 36.8 | 35.6 | 1.4 | 0.2 | A | A |
| E. 2-4 | *3 | 3/3 | 2.0 | 2.2 | 34.3 | 35.4 | 36.9 | 37.0 | 38.7 | 2.7 | 4.4 | A | A |
| E. 2-5 | Fluorine based silicone oil | 3 | 2.7 | 3.0 | 31.8 | 34.5 | 37.2 | 39.4 | 43.8 | 7.6 | 12.0 | B | D |
| C. 2-1 | Fluorine based silicone oil | 0.3 | −2.2 | −2.5 | 39.5 | 27.2 | 19.0 | 16.6 | — | −22.9 | — | D | D |
| C. 2-2 | Fluorine based silicone oil | 1.2 | −0.5 | −0.6 | 37.3 | 28.1 | 23.8 | 21.0 | — | −16.3 | — | D | D |
| C. 2-3 | Di-methyl poly-siloxane/dry type aminosilane | 0.6/3 | 3.5 | 3.9 | 32.7 | 37.4 | 42.4 | 43.6 | — | 10.9 | — | D | D |
| C. 2-4 | Wet type i-butylmethoxy-silane/dry type aminosilane | 3/3 | 4.0 | 4.4 | 32.6 | 40.8 | 43.0 | 45.7 | — | 13.1 | — | D | D |
| C. 2-5 | | — | — | — | 34.4 | 30.1 | 24.9 | 21.0 | — | −13.4 | — | D | D |

Here "—" indicates that measurement was not made,
*1: Amount of surface treatment
E.: Example,
C.: Comparison example,
*2: Surface charge density ($\times 10^{-4}$ C/m$^2$),
*3: Wet type i-butylmethoxy-silane/wet type aminosilane Similar to Experimental Example 1, by making the surface charge density of the opposite polarity particles in the developer to be in the range of 0.5 to 3.0 times the surface charge density of the carrier in the developer, the effect of supplementing the charge applying property of the carrier due to the adhesion of the opposite polarity particles is brought out sufficiently, and the charge applying property of the carriers is maintained near the initial state. As a result, it was possible to suppress the change in the amount of toner charge from the initial condition to within the range of 0 to 5 μC/g at the point of 50 k sheets of printing, and there was no occurrence of problems associated with decrease in the toner charge such as increase in the fogging of the background or toner splashing within the apparatus, or of problems associated with increase in the toner charge such as reduction in the density or deterioration of the dot reproducibility. In particular, by making the surface charge density of the opposite polarity particles in the developer to be in the range of 1.2 to 2.2 times the surface charge density of the carrier in the developer, there is almost no change in the amount of toner charge with increase in the number of printed sheets, and it is possible to suppress it to within the range of 0 to 5 μC/g even at the point after 100 k pages of printing, and it is possible to achieve a long life of the development apparatus.

Experimental Example 3

A print durability test was conducted using a development apparatus having a configuration identical to that of Experimental Example 2, excepting that the opposite polarity particle recovery member was removed. The developer used had a carrier for the bizhub C350 manufactured by Konica-Minolta Business Technologies Co. Ltd., (volume average particle diameter of about 33 μm) and a toner on which the same different types of particles were added externally as those used in Experimental Example 1 and Experimental Example 2 above.

The amounts of toner charge during the print durability test are shown in Table 3.

TABLE 3

| | Opposite polarity particles | | | Ratio with carrier surface | Amount of toner charging (-μC/g) | | | | | Change of amount of toner charging (-μC/g) | | Carrier charge maintenance | |
|---|---|---|---|---|---|---|---|---|---|---|---|---|---|
| | Surface treatment | *1 | *2 | charge density | 0k | 10k | 30k | 50k | 100k | 50k | 100k | 50k | 100k |
| C. 3-1 | *3 | 0.3 | −2.2 | −2.5 | 40.3 | 28.8 | 22.3 | 18.4 | — | −21.9 | — | D | D |
| C. 3-2 | *3 | 1.2 | −0.5 | −0.6 | 37.2 | 30.3 | 25.3 | 21.4 | — | −15.8 | — | D | D |
| C. 3-3 | *3 | 1.6 | 0.5 | 0.5 | 36.9 | 31.1 | 24.7 | 24.0 | — | −12.9 | — | D | D |
| C. 3-4 | *3 | 2 | 1.0 | 1.2 | 35.2 | 30.0 | 26.4 | 20.7 | — | −14.5 | — | D | D |
| C. 3-5 | Di-methyl poly-siloxane | 0.6 | 1.2 | 1.3 | 35.5 | 30.1 | 24.9 | 21.0 | — | −14.5 | — | D | D |
| C. 3-6 | Wet type i-butylmethoxy-silane/wet type aminosilane | 3/3 | 2.0 | 2.2 | 34.0 | 29.8 | 26.5 | 23.1 | — | −10.9 | — | D | D |
| C. 3-7 | *3 | 3 | 2.7 | 3.0 | 33.8 | 28.7 | 24.9 | 20.7 | — | −13.1 | — | D | D |
| C. 3-8 | Di-methyl poly-siloxane/dry type aminosilane | 0.6/3 | 3.5 | 3.9 | 31.9 | 30.0 | 25.5 | 21.4 | — | −10.5 | — | D | D |

TABLE 3-continued

| | Opposite polarity particles | | | Ratio with carrier surface | Amount of toner charging (-μC/g) | | | | | Change of amount of toner charging (-μC/g) | | Carrier charge maintenance | |
|---|---|---|---|---|---|---|---|---|---|---|---|---|---|
| | Surface treatment | *1 | *2 | charge density | 0k | 10k | 30k | 50k | 100k | 50k | 100k | 50k | 100k |
| C. 3-9 | Wet type i-butylmethoxy-silane/dry type aminosilane | 3/3 | 4.0 | 4.4 | 32.8 | 28.7 | 25.2 | 20.8 | — | −12.0 | — | D | D |
| C. 2-5 | | — | — | — | 35.1 | 29.8 | 24.8 | 20.2 | — | −14.9 | — | D | D |

Here "—" indicates that measurement was not made,
*1: Amount of surface treatment
C.: Comparison example,
*2: Surface charge density ($\times 10^{-4}$ C/m$^2$)
*3: Fluorine based silicone oil When the development apparatus of this configuration was used, the separation and recovery of the opposite polarity particles is not carried out, and the effect of suppression of carrier deterioration was not obtained for any types of opposite polarity particles added externally to the toner.

Experimental Example 4

A print durability test was conducted using a development apparatus having a configuration identical to that of Experimental Example 2, with the developer used having a carrier for the bizhub C350 manufactured by Konica-Minolta Business Technologies Co. Ltd., (volume average particle diameter of about 33 μm) and a toner prepared according to the following method. In other words, for 100 parts by mass of toner base material with a volume average particle diameter of about 6.5 μm manufactured by the wet type particle manufacturing method, external addition processing was carried out as the first stage of external addition processing of, as the external additive a, 0.6 parts by mass of hydrophobic silica with an number average primary particle diameter of 20 nm to which surface treatment was made using hexamethyldisilazane (HMDS) which is a hydrophobizing agent, and as the external additive b, 0.5 parts by mass of anatase type titanium dioxide with an average primary particle diameter of 30 nm to which surface treatment was made in an aqueous wet atmosphere using isobutyltrimethoxysilane which is a hydrophobizing agent, and these were subjected to surface treatment using a Henschel mixer (manufactured by Mitsui Metal Mining Corp.) for 2 minutes at a speed of 40 m/s.

Next, for the toner to which this surface treatment has been done, external addition processing was carried out with the external additive c, which is the opposite polarity particle, as the second stage of external addition processing. This processing was made using, as the external additive c, 100 parts by mass of strontium titanate with a number average particle diameter of 350 nm and carrying out surface treatment using 0.6 parts by mass of dimethyl poly-siloxane using a Henschel mixer under the conditions indicated in Table 4. The result of measurement of the ratio of the surface charge density of the opposite polarity particle which is the external additive c at this time to the surface charge density of the carrier using the method indicated in Experimental Example 1 are shown in Table 4. The print durability test was carried out under the same conditions as those in Experimental Example 2 except those of the developer.

Further, for the developer used, the ratio of the opposite polarity particles separated from the toner by the opposite polarity particle recovery member was measured and this was taken as the opposite polarity particle separation rate. The method of measuring the opposite polarity particle separation rate was as follows. In other words, the developing unit was operated under the same conditions as those during image formation, a toner layer was formed on the toner supporting member, and the toner in that toner layer was collected. Further, on the other hand, unused toner before mixing with the carrier was taken, and the amount of strontium titanate present in these two were measured using Induction Coupling Plasma Emitted Light Spectroscope (ICP-AES). A value is obtained by subtracting the proportion of strontium titanate in the toner on the toner supporting member derived from this divided by the proportion of strontium titanate in the unused toner from 1, and this value was taken as the rate of separation of the opposite polarity particles from the toner.

The results of the rate of separation of the opposite polarity particles and of the print durability test are shown in Table 5.

TABLE 4

| | | External additive addition method | | | | | | | | | |
|---|---|---|---|---|---|---|---|---|---|---|---|
| | | First stage | | | Second stage | | | | | | |
| | Developer mode | Process particle | *1 | *2 | Process particle | Surface treatment | Amount of surface treatment | *4 | Ratio with carrier surface charge density | *1 | *2 |
| E. 4-1 | Developing unit 2 | a, b | 40 m/s | 2 min | c | *3 | 0.6 | 1.2 | 1.3 | 10 m/s | 20 min |
| E. 4-2 | Developing unit 2 | a, b | 40 m/s | 2 min | c | *3 | 0.6 | 1.2 | 1.3 | 20 m/s | 20 min |
| E. 4-3 | Developing unit 2 | a, b | 40 m/s | 2 min | c | *3 | 0.6 | 1.2 | 1.3 | 30 m/s | 20 min |
| E. 4-4 | Developing unit 2 | a, b | 40 m/s | 2 min | c | *3 | 0.6 | 1.2 | 1.3 | 40 m/s | 20 min |

TABLE 4-continued

| | | External additive addition method | | | | | | | | | |
|---|---|---|---|---|---|---|---|---|---|---|---|
| | | First stage | | | Second stage | | | | | | |
| | Developer mode | Process particle | *1 | *2 | Process particle | Surface treatment | Amount of surface treatment | *4 | Ratio with carrier surface charge density | *1 | *2 |
| E. 4-5 | Developing unit 2 | a, b | 40 m/s | 2 min | c | *3 | 0.6 | 1.2 | 1.3 | 60 m/s | 20 min |
| E. 4-6 | Developing unit 2 | a, b | 40 m/s | 2 min | c | *3 | 0.6 | 1.2 | 1.3 | 60 m/s | 20 min × 3 |
| E. 4-7 | Developing unit 2 | a, b | 40 m/s | 2 min | c | *3 | 0.6 | 1.2 | 1.3 | 60 m/s | 20 min × 5 |

E.: Example,
*1: Process speed,
*2: Process time
*3: Di-methyl poly-siloxane,
*4: Surface charge density ($\times 10^{-4}$ C/m$^2$)

TABLE 5

| | Rate of opposite polarity particle separation | Amount of toner charging (-μC/g) 0k | 10k | 30k | 50k | Change of amount of toner charging (-μC/g) | Carrier charge maintenance |
|---|---|---|---|---|---|---|---|
| Example 4-1 | 64.1 | 36.9 | 32.8 | 31.0 | 31.3 | −5.6 | B |
| Example 4-2 | 50.3 | 36.2 | 36.4 | 35.0 | 36.2 | 0.0 | A |
| Example 4-3 | 31.3 | 36.2 | 35.4 | 35.9 | 36.6 | 0.4 | A |
| Example 4-4 | 18.5 | 35.6 | 33.8 | 36.4 | 35.6 | 0.0 | A |
| Example 4-5 | 9.3 | 34.0 | 34.8 | 32.8 | 32.0 | −2.0 | A |
| Example 4-6 | 5.8 | 35.1 | 32.3 | 30.1 | 28.6 | −6.5 | B |
| Example 4-7 | 3.7 | 35.4 | 30.0 | 28.4 | 26.3 | −9.1 | B |

When the separation rate is in the range of 9.3% to 50.3%, the amount of opposite polarity particles recovered into the developer is appropriate, and it is clear that the effect of suppressing carrier deterioration due to the opposite polarity particles is being obtained appropriately. This is considered to be because, if the separation rate is too low, the recoverability of opposite polarity particles becomes poor, and the effect of suppressing the carrier deterioration due to the opposite polarity particles becomes weaker, and on the other hand, if the separation rate is too high, although the effect of suppressing the carrier deterioration is obtained sufficiently, the recovered opposite-polarity particles get adhered excessively to the toner in the developer as a result of which the amount of charging of the toner decreases.

Experimental Example 5

Figure 4:
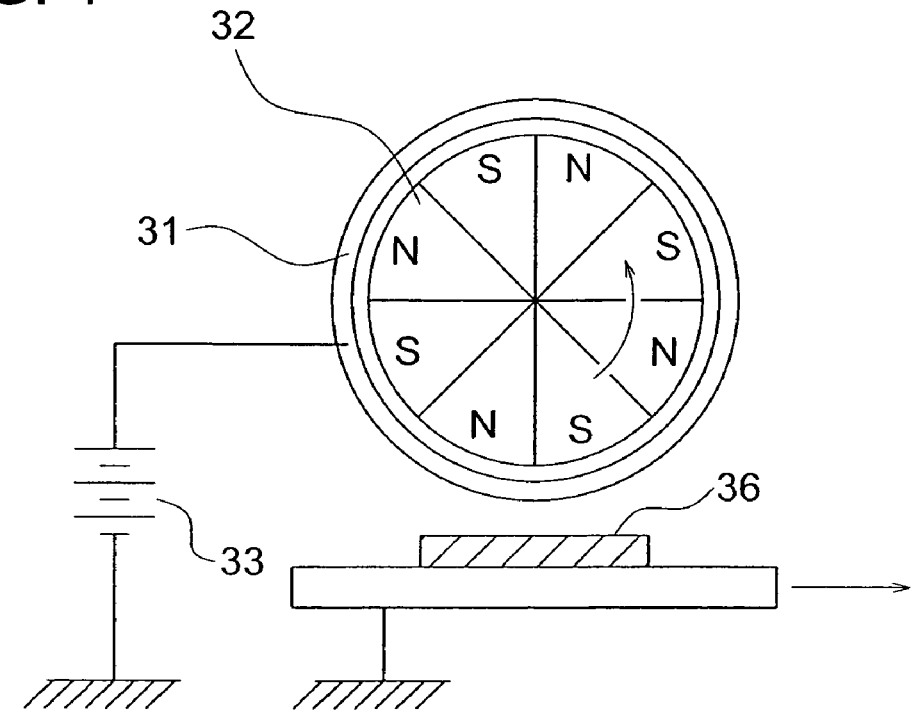
FIG. 4 is an outline configuration diagram showing a part of the apparatus for measuring the surface charge density.
Figure 6:
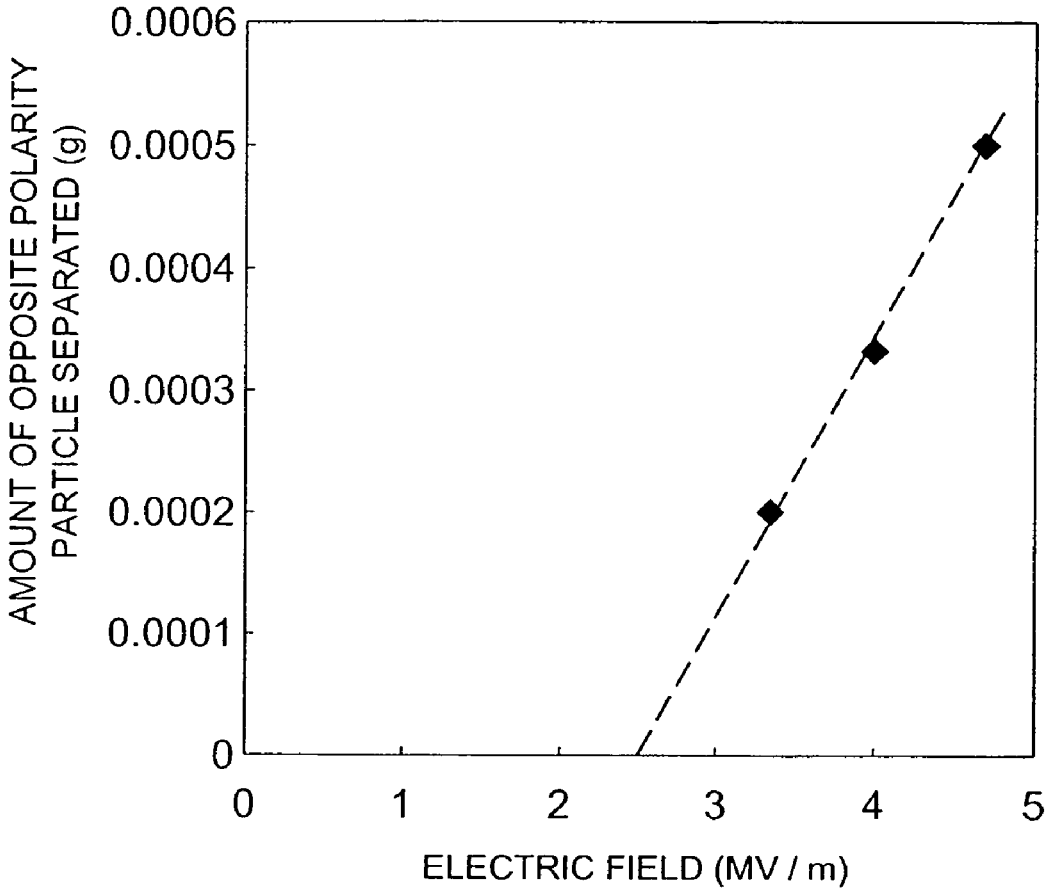
FIG. 6 is a diagram showing the electric field strength and the amount of opposite polarity particles separated.

Using the apparatuses of FIG. 4 and FIG. 5, a toner layer having opposite polarity particles was formed on one of the parallel plate electrodes using the procedure indicated during the measurement of the surface charge density of opposite polarity particles. The same toner was used as the one used in the Experimental Examples 1 and 2. The amount of strontium titanate which is the opposite polarity particle in this toner was 2 percent by mass. The results shown in FIG. 6 were obtained when the amount of the opposite polarity particles separated from the toner layer formed on the electrode due to the electric field was evaluated. As is shown in FIG. 6, it became clear that the amount of opposite particles separated due to the electric field started rising from an electric field value of about $2.5\times10^6$ V/m, and that the amount of separation increased as the electric field strength increased. In addition, when an electric field of more than $5.5\times10^6$ V/m was used, leakage occurred between the toner supporting member and the developer supporting member. From the above facts, it can be understood that in order to separate the opposite polarity particles in the toner, it is effective to use an electric field equal to or more than $2.5\times10^6$ V/m but less than or equal to $5.5\times10^6$ V/m.

What is claimed is:

1. A method for developing an electrostatic latent image formed on an image carrier, the method comprising the steps of:

(a) stirring, in a developer tank, developer which contains toner, carrier for charging the toner, and opposite polarity particles which is to be charged with an opposite polarity to a polarity of electrostatic charge of the toner, the opposite polarity particles being charged, in the developer, to have a surface charge density in a range from 0.5 to 3.0 times of a surface charge density of the carrier;

(b) supporting the developer stored in the developer tank on a developer supporting member to convey the developer toward a development area;

(c) separating the opposite polarity particles and the toner in the developer supported on the developer supporting member from each other, at an upstream side of the development area in a moving direction of the developer; and (d) conveying the toner separated from the opposite polarity particles to the development area to develop the electrostatic latent image with the toner.

2. The method of claim 1, wherein the step (c) includes the step of:

(e) forming an electric field between the developer supporting member and an electric field forming member which is provided facing the developer supporting member, so as to remove the opposite polarity particles from the developer on the developer supporting member.

3. The method of claim 2, wherein the electric field formed in the step (e) is an alternating electric field.

4. The method of claim 3, wherein the alternating electric field has a maximum absolute value of not less than $2.5\times10^6$ V/m and not more than $5.5\times10^6$ V/m.

5. The method of claim 2, wherein the electric field forming member functions as a regulating member for regulating an amount of the developer on the developer supporting member.

6. The method of claim 2, wherein the electric field forming member forms a part of a case housing the developer supporting member.

7. The method of claim 2, wherein in the step (e) a separation ratio of the opposite polarity particles is from the toner is from 9.3% to 50.3%.

8. The method of claim 1, wherein the step (d) includes the step of:

(f) removing the toner from the developer on the developer supporting member and transferring the toner onto a toner supporting member provided between the development area and the developer supporting member, wherein in the step (d) the toner is conveyed to the development area by the toner supporting member.

9. The method of claim 8, wherein the toner in the developer is charged negative, and the method includes the step of:

(g) applying to the toner supporting member a voltage whose average is higher than an average of a voltage applied to the developer supporting member.

10. The method of claim 8, wherein the toner in the developer is charged positive, and the method includes the step of:

(h) applying to the toner supporting member a voltage whose average is lower than an average of a voltage applied to the developer supporting member.

11. The method of claim 8, comprising the step of:

(i) forming an alternating electric field between the toner supporting member and the developer supporting member so as to remove the toner from the developer on the developer supporting member.

12. The method of claim 11, wherein the alternating electric field formed in the step (i) has a maximum absolute value of not less than $2.5\times10^6$ V/m and not more than $5.0\times10^6$ V/m.

13. The method of claim 11, wherein in the step (f) a separation ratio of the opposite polarity particles is from the toner is from 9.3% to 50.3%.

14. The method of claim 1, wherein a number average particle diameter of the opposite polarity particles is from 100 to 1000 nm.

15. The method of claim 1, wherein an amount of the opposite polarity particles stirred in the step (a) is from 0.01 to 5.00 parts by mass with respect to 100 parts by mass of the carrier.

16. The method of claim 1, wherein an amount of the opposite polarity particles stirred in the step (a) is from 0.01 to 2.00 parts by mass with respect to 100 parts by mass of the carrier.

17. The method of claim 1, comprising the step of:

(j) supplying the developer tank with replenishment toner to which opposite polarity particles have been externally added.

18. The method of claim 17, wherein a percentage of the opposite polarity particles externally added to the replenishment toner is from 0.5 to 10.0% by mass with respect to the toner.

19. The method of claim 17, wherein a percentage of the opposite polarity particles externally added to the replenishment toner is from 0.5 to 5.0% by mass with respect to the toner.

20. The method of claim 17, wherein the replenishment toner is externally added with same-polarity particles which are to be charged with the same polarity as the toner.

21. The method of claim 20, wherein the replenishment toner is prepared by externally adding the same-polarity particles to toner and then externally adding the opposite polarity particles to the toner to which the same polarity particles have been added.

22. A developing method for developing an electrostatic latent image with toner, the developing method comprising the steps of:

conveying developer stored in a developer tank by use of a developer supporting member, wherein the developer includes the toner, carrier for charging the toner and opposite polarity particles which are charged in an opposite polarity to a polarity of an electrostatic charge of the toner, and a surface charge density of the opposite polarity particles is in the range from 0.5 to 3.0 times of a surface charge density of the carrier;

separating the opposite polarity particles from the developer on the developer supporting member at a position of an upstream side of the development area in a developer moving direction, thereby the developer from which the opposite polarity particles has been separated is conveyed to the development area; and collecting the separated opposite polarity particles into the developer tank.

23. A developing method for developing an electrostatic latent image with toner at a development area, the developing method comprising the steps of:

conveying developer stored in a developer tank by use of a developer supporting member, wherein the developer includes the toner, carrier for charging the toner and opposite polarity particles which are charged in an opposite polarity to a polarity of an electrostatic charge of the toner, and a surface charge density of the opposite polarity particles is in the range from 0.5 to 3.0 times of a surface charge density of the carrier;

separating the toner from the developer on the developer supporting member at a position of an upstream side of the development area in a developer moving direction; and conveying the separated toner to the development area.

* * * * *

UNITED STATES PATENT AND TRADEMARK OFFICE

CERTIFICATE OF CORRECTION

PATENT NO. : 7,968,267 B2
APPLICATION NO. : 12/769423
DATED : June 28, 2011
INVENTOR(S) : Takeshi Maeyama et al.

It is certified that error appears in the above-identified patent and that said Letters Patent is hereby corrected as shown below:

In the Claims

In column 33, claim 7, line 32, after "opposite polarity particles" replace "is from the" with --from the--.

In column 33, claim 13, line 61, after "opposite polarity particles" replace "is from the" with --from the--.

Signed and Sealed this
Twenty-fourth Day of July, 2012

David J. Kappos
*Director of the United States Patent and Trademark Office*